US006741711B1

(12) United States Patent
Sibbald

(10) Patent No.: US 6,741,711 B1
(45) Date of Patent: May 25, 2004

(54) METHOD OF SYNTHESIZING AN APPROXIMATE IMPULSE RESPONSE FUNCTION

(75) Inventor: Alastair Sibbald, Maidenhead (GB)

(73) Assignee: Creative Technology Ltd. (SG)

( * ) Notice: Subject to any disclaimer, the term of this patent is extended or adjusted under 35 U.S.C. 154(b) by 360 days.

(21) Appl. No.: 09/711,539

(22) Filed: Nov. 14, 2000

(51) Int. Cl.[7] ..... H04R 5/02
(52) U.S. Cl. ..... 381/310; 381/61
(58) Field of Search ..... 381/61, 62, 63, 381/309, 310, 103

(56) References Cited

U.S. PATENT DOCUMENTS

| | | | | |
|---|---|---|---|---|
| 5,369,710 A | | 11/1994 | Asai | |
| 5,371,799 A | | 12/1994 | Lowe et al. | |
| 5,381,482 A | * | 1/1995 | Matsumoto | 381/63 |
| 5,572,591 A | * | 11/1996 | Numazu | 381/63 |
| 5,796,845 A | * | 8/1998 | Serikawa | 381/63 |
| 5,812,674 A | | 9/1998 | Jot et al. | |
| 6,385,320 B1 | * | 5/2002 | Lee | 381/63 |

FOREIGN PATENT DOCUMENTS

| | | |
|---|---|---|
| EP | 0 687 130 | 6/1995 |
| EP | 0 827 361 | 3/1998 |
| EP | 0 966 179 | 12/1999 |
| GB | 2 314 749 | 1/1998 |
| GB | 2 337 676 | 11/1999 |
| GB | 2 345 622 | 7/2000 |
| GB | 2 352 152 | 1/2001 |
| JP | 03038695 | 2/1991 |
| JP | 11243598 | 9/1999 |

OTHER PUBLICATIONS

PCT Search Report, dated Feb. 4, 2003.
PCT Search Report, dated Dec. 18, 2002.
Foreign Search Report for GB 0022892.4, dated Mar. 28, 2001.
Foreign Search Report for GB 0022891.6, dated Mar. 26, 2001.

* cited by examiner

*Primary Examiner*—Minsun Oh Harvey

(57) ABSTRACT

A method of synthesizing an approximate impulse response function from a measured first impulse response function in a given sound field includes: sampling an early part of the impulse response for the given sound field; synthesizing a part impulse response which approximates to the sampled part of the given impulse response by curve fitting using a plurality of basis functions provided by respective multi-tap FIR filters, said part impulse response including scattering artefacts; synthesizing subsequent further part impulse responses using the same filters; applying an envelope function which decreases the amplitude with increasing time, and constructing an extended approximate impulse response by combining successive part impulse responses with irregular overlap to minimize audible artifacts. The synthesized impulse response function has psycho-acoustic properties similar to those of the original impulse response function, and enables fewer taps to be employed.

14 Claims, 21 Drawing Sheets

1. Multi-wavelet generation and combination

METHOD OF SYNTHESIZING AN APPROXIMATE IMPULSE RESPONSE FUNCTION

BACKGROUND OF THE INVENTION

1. Field of the Invention

The present invention relates to a method of synthesising an approximate impulse response function from a measured first impulse response function in a given sound field. It relates particularly, though not exclusively, to impulse responses in sound fields in which scattering is present.

2. Background

A first aspect of the present invention relates to 3D-audio signal-processing based on Head-Related Transfer Functions (HRTFs), in which recorded sounds can be reproduced so as to appear to originate in full, three-dimensional space around the listener, using only a single pair of audio channels, and reproduced via either a conventional pair of loudspeakers or headphones.

A second aspect of the present invention relates to headphone "virtualisation" technology, in which an audio signal is processed such that, when it is auditioned using headphones, the source of the sound appears to originate outside the head of the listener. (At present, conventional stereo audio creates sound-images which appear—for the most part—to originate inside the head of the listener, because it does not contain any three-dimensional sound-cues.) This application includes single channel virtualisation, in which a single sound source is positioned at any chosen point in space, and two-channel virtualisation, where a conventional stereo signal-pair are processed so as to appear to originate from a virtual pair of loudspeakers in front of the listener. This method also extends to the virtualisation of multi-channel cinema surround-sound, in which it is required to create the illusion that the headphone listener is surrounded by five or more virtual loudspeakers.

Another aspect of the invention relates to its application in virtual 3D-reverberation processing.

A co-pending patent application, filed together with the present application, provides a comprehensive explanation of the difficulty in creating effective headphone "externalisation" (including prior art), and describes the method by which it can be successfully achieved. Essentially, the inventor found that wave-scattering effects are critical for achieving adequate headphone externalisation. What is meant by this is that, when sound is emitted in a scattering environment (and most practical environments do contain physical clutter which scatters sound-waves), then the wave-front can be considered as becoming fragmented into a multitude of elemental units, each of which is scattered (i.e. reflected, diffracted and partially absorbed) differently by the objects and surfaces present in the room. This multiplicity of elemental components eventually arrive irregularly at the listener's head after different time periods have elapsed (depending on their scattered path-lengths). Consequently, the incoming waves to the listener are characterised by a clean "first-arrival", straight from the source itself in a direct line to the listener, closely followed by a period of "turbulence" created by the arrival of the multiplicity of scattered elemental waves. Note that this effect occurs both inside rooms, and outside rooms. For example, in a forest, wave-scattering would be predominant; there would be ground-reflections, but no reverberation. In a partially-cluttered room (most real world rooms), then the scattered signals would be experienced before any reflections or reverberation from the walls, and hence scattering is still the dominant effect. The present inventor has discovered that it is the turbulent period which is critical to sound image externalisation for headphone users. In practise, this period begins within a few milliseconds after the first-arrival, builds to a maximum value over a slightly longer time period, and then decays exponentially over a period of tens of milliseconds. This is consistent with the relative scattering path lengths (compared to the direct sound path) lying in the range from one meter to ten or more meters. The maximum amplitude of the envelope of the turbulent signal is typically 5 to 20% of the amplitude of the direct signal.

Our co-pending patent application describes practical examples of various embodiments of applications in which the synthesis of wave-scattering effects is required. However, a common feature of these embodiments is the requirement for a "wave-scattering" filter, which would simulate the turbulent period of scattered-wave arrivals. This can be accomplished in a conventional manner by means of a digital finite-impulse response (FIR) filter, in which the impulse response of the scattering environment could be measured and replicated, sample by sample. However, at a typical audio sampling rate of 44.1 kHz, then in order to simulate a sufficiently long period of turbulence (say, 100 ms in duration), then a single filter would need to be 4,100 taps in length (and two of these would be needed for many applications). This is impracticably long, by almost two orders of magnitude. For comparison, when HRTF processing is carried out on the CPU of a computer, it is common to use pairs of 25-tap FIR filters, and no more than eight of these can be tolerated in interactive computer applications at present (i.e. 200 taps), otherwise the CPU becomes excessively burdened. As a rule of thumb, it would be useful if the turbulent period of wave-scattering could be simulated using a signal-processing engine having a processing requirement which corresponds to a 100-tap (or less) FIR filter.

SUMMARY OF THE INVENTION

In summary, what is required is a processing-efficient means of reproducing the turbulent features of audio wave-scattering effects as they occur at the ears of the listener. It is an aim of the present invention to provide a method for achieving this goal.

According to a first aspect of the present invention there is provided a method as specified in claims 1–13.

According to a second aspect of the present invention there is provided a method as specified in claims 14–15.

According to a third aspect of the present invention there is provided a impulse response function as specified in claim 16.

According to a fourth aspect of the present invention there is provided an audio signal as specified in claim 17.

According to a fifth aspect of the present invention there is provided signal processing apparatus as specified in claim 18.

According to a sixth aspect of the present invention there is provided a portable audio system as specified in claim 19.

According to a seventh aspect of the present invention there is provided a mobile or cellular telephone handset as specified in claim 20.

According to an eighth aspect of the present invention there is provided an electronic musical instrument as specified in claim 21.

According to a ninth aspect of the present invention there is provided a signal processing system for adding reverberation to an audio signal as claimed in claim 22.

BRIEF DESCRIPTION OF THE DRAWINGS

The invention will now be described, by way of example only, with reference to the accompanying schematic drawings, in which:

FIG. 15B shows a further embodiment of a sequencing and triggering system using fade-in.

DETAILED DESCRIPTION OF ILLUSTRATIVE EMBODIMENTS

The present invention provides a very efficient means of synthesising audio-wave scattering effects as would be perceived by a listener. At the outset, the significant features of the wave-scattering phenomenon were unknown, and so it was unclear whether the effects could, indeed, be synthesised, and if they could, whether they could be simplified at all. Accordingly, a suitable sequence of wave-scattering was recorded for inspection and experimentation, and this was used as a "benchmark" for simulation.

The invention is based on building up a lengthy, complex impulse-response pattern from an elemental basis function. By appropriate choice of basis function and method of use, an impulse response pattern can be matched accurately to both real, measured data, and it can be fitted to synthesised data, also. In short, this provides an efficient means to synthesise a lengthy impulse response.

Furthermore, in addition to this economical method, an additional means has been found to further reduce the amount of signal processing required to simulate a very lengthy response, by means of a limited, irregular repetition of a short segment of wave-scattering data. Finally, when the repeated section is made sufficiently long in duration, say 30 ms or more, then a re-iterative feedback loop can be incorporated to extend the effective period of simulation to more than 100 ms without the introduction of any audible artefacts, thus providing an elegant and natural decay to the effect.

The following description relates to a particular, fixed signal-processing architecture implementation of the invention (which will be referred to hereinafter as the "Wavelet Engine"). When an audio signal is fed into the Wavelet Engine, it is convolved with the required, lengthy impulse response with which the Engine has been programmed, and the resultant audio output signal possesses the requisite wave-scattering characteristics and properties.

There are, of course, many possible variations and permutations of the examples shown here. For example, the type and number of wavelets can be altered, the sequencing can be triggered differently, and so on. Also, it is possible to create a dynamic version of the engine, in which the various parameters could be modified in real-time, and interactively. It will be appreciated that the scope of the present invention is not limited to the specific examples shown here.

Figure 1:
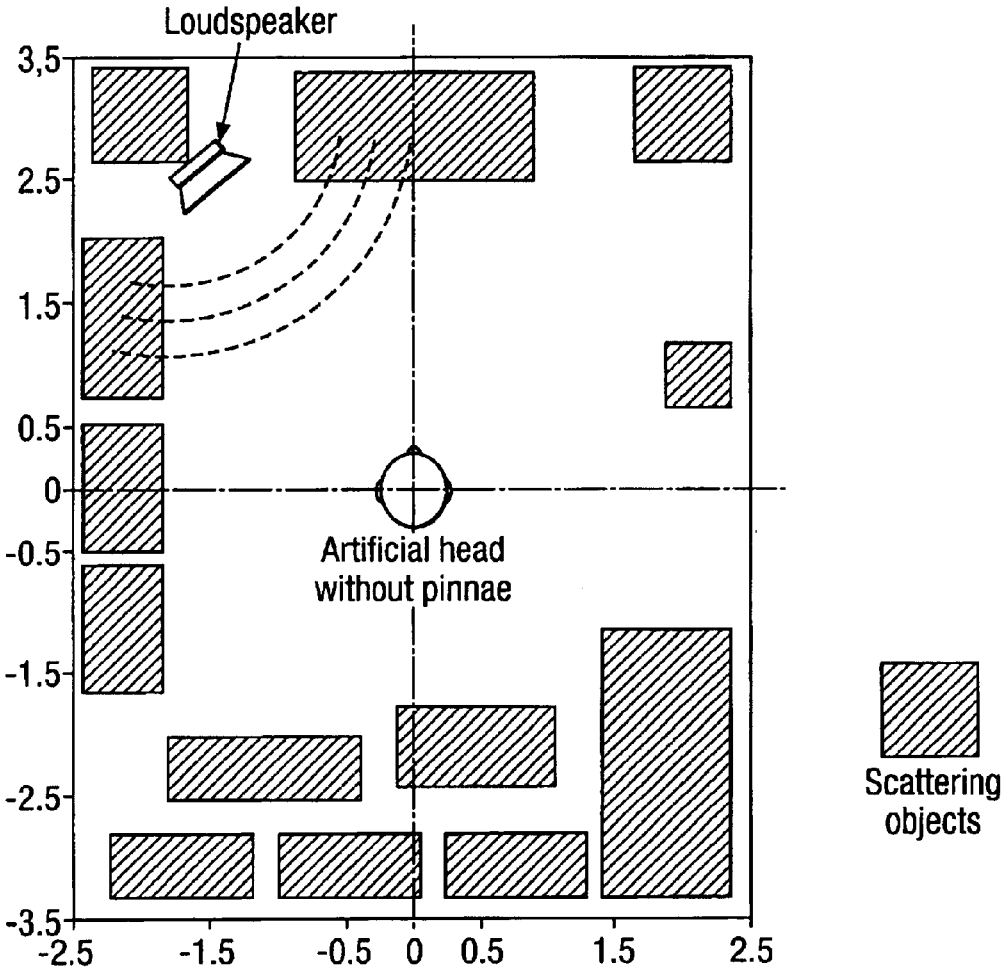
FIG. 1 shows a plan view of the room in which the impulse response measurements were made.

Firstly, because the importance of wave-scattering is newly discovered, an understanding is necessary of the relative significance of the various features of the turbulent wave-scattering period. Accordingly, an audio recording was made of an impulse in an average scattering environment (a "Listening Room"). In the present case, a band-limited impulse (limited to the range 80 Hz to 20 kHz) was used as the source, via a B&W type 801 loudspeaker. This latter has a very uniform and flat response through the audio spectrum, thus providing relatively "uncoloured" data. The audio signals were measured using a B&K type 5930 artificial head unit with its pinnae (outer-ear flaps) removed. This method was chosen so as to include the "baffle" effect of the head between the two recording microphones, on either side of the head unit, whilst ensuring that the acoustic filtering effects of the pinnae were absent. This would provide ideal data for use in conjunction with 3D-audio synthesis where the requirement is to have scattering waveforms representative of the spatial positions just adjacent to the ears, for use with diffuse HRTFs. The relative positions of the loudspeaker and artificial head were as described in our co-pending patent application, and as shown here in FIG. 1, with the sound-source to the front and left of the artificial head, at an azimuth angle of −30°. There was an average amount of "clutter" in the room, including the large B&W 801 loudspeakers themselves, tables, equipment racks, and some cupboards, and the approximate positions of these items are also shown in FIG. 1. Both channels of the recorded waveform are shown here in FIG. 2; the left-channel is uppermost and the right-channel is the lower of the two. The first, direct arrival of the impulse can be seen at the left of the Figure, where it can be seen that the left-channel arrival occurs first, and is the larger of the two. In order to show the most detail, only the first 50 ms following the first arrival are depicted here. In practise, the scattering becomes propagated and prolonged by wall reflections, and therefore becomes incorporated into the reverberation, which continues visibly a little beyond 100 ms in the present example. FIG. 3 shows the same waveform of FIG. 2 again, but with the amplitude scale increased by a factor of ×4 to show more detail.

The following experiments were carried out on the recording of the impulse response, using a computer-based digital editor to ascertain the relative importance of several features, in order to create the most efficient synthesis means. The sound was auditioned using headphones. In the original recording, the impulse can be heard clearly outside the head of the listener, in the approximate location of the loudspeaker relative to the artificial head (FIG. 1).

1. Removal of Early Reflections

The first reflections to arrive are the ground and ceiling reflections, occurring between 2.0 and 3.5 ms after the first arrival. These are clearly visible in FIG. 2, especially in the uppermost signal (left or near ear). These were deleted (i.e. replaced by silence), and then the impulse was auditioned and compared with the original. There was virtually no detectable difference—no deleterious effect at all. It was concluded that, contrary to prior art teaching, the early reflections played no significant part in externalisation. The experiments below were continued without these reflections.

2. Duration of the Scattering Period

Figure 2:
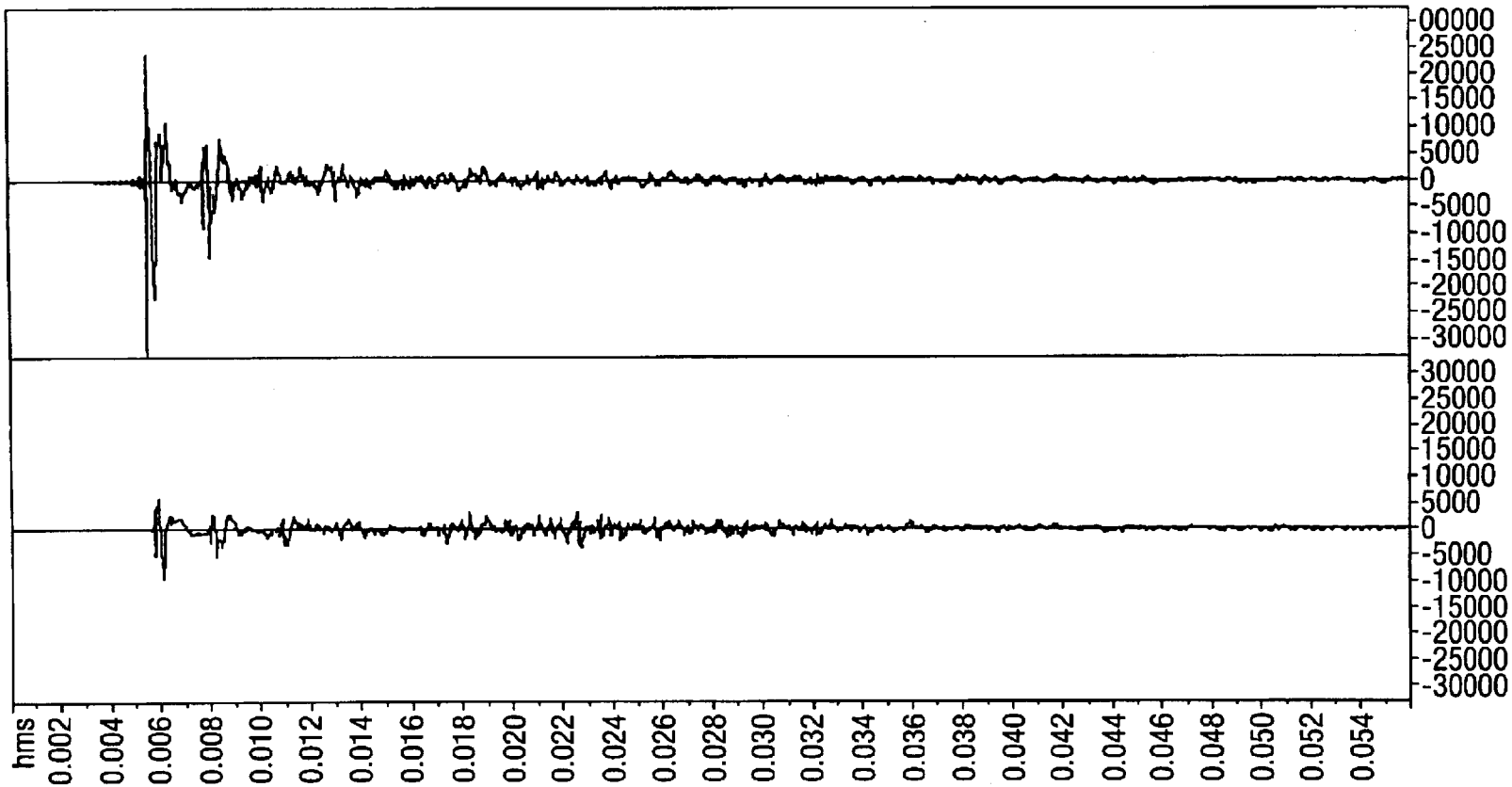
FIG. 2 shows the recorded left and right channel audio signals.
Figure 3:
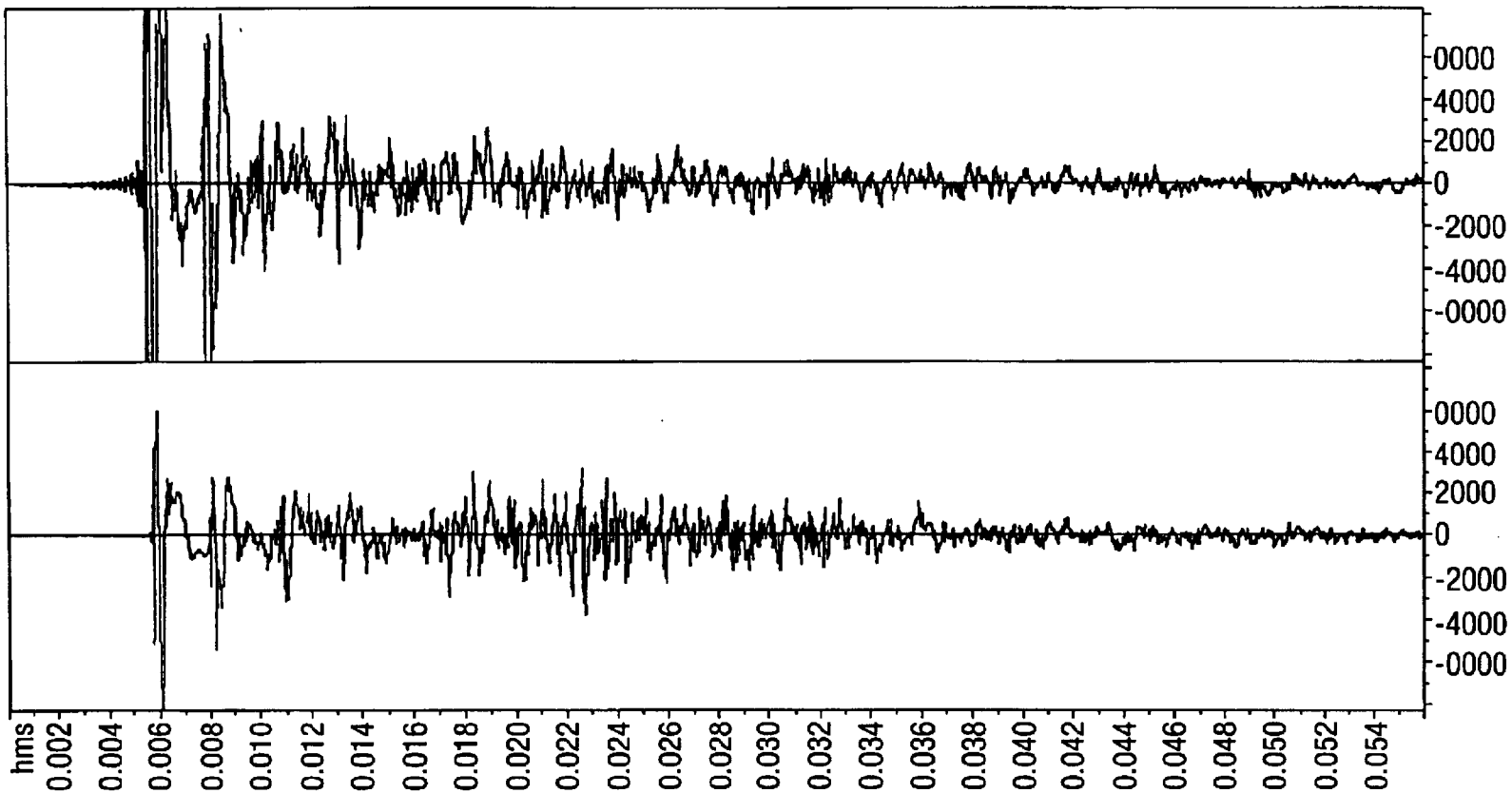
FIG. 3 shows the data of FIG. 2 magnified 4 times.

In order to ascertain for what period it would be necessary to synthesise scattering effects to achieve externalisation of the headphone auditioned image, the recorded wave of FIGS. 2 and 3 was truncated in steps from 120 ms down to 20 ms. When the truncation reached 40 ms, the truncation of the sound could be distinctly heard, but the externalisation effect was still very effective. When the truncation period was less severe, at 70 ms or more, then the overall effect was deemed very good, featuring excellent externalisation and no audible truncation. It was concluded that about 70 ms or more of synthesised wave-scattering would be required.

3. Required Bandwidth

The scattering section of the recording (that is, all but the first arrival) was band-pass filtered, progressively, so as to gradually limit the high-frequency (HF) content. The results were as follows.

80 Hz to 10 kHz: No significant change.

80 Hz to 5 kHz: Externalisation intact, although small tonal change.

80 Hz to 3 kHz: Significant tonal change.

By band-limiting the turbulent wave data, some of the detail is removed. It becomes simplified, and is therefore easier to synthesise. It was concluded that restriction of the bandwidth of the wave-scattering synthesis to below 5 kHz was a reasonable step, in the first instance.

4. Left-right Correlation

In practise, one would expect a significant degree of signal correlation between the left- and right-channels at low frequencies, say below 200 Hz. This is because the recording microphone positions—representing the physical spacing of the ears—were one head-width apart. At these low frequencies, where the wavelength is much greater than head width, there can be little phase difference between the two microphones, and so the signals are mutually correlated. At higher frequencies, where the wavelength is much shorter (say 2 kHz and higher), then head-shadowing, diffraction effects and phase ambiguity occur, and there is no reason why this correlation should be maintained. In order to test what is important here, the wave-scattering section of the recording was modified as follows and compared to the original. (The early reflections are still absent for this.)

1. The right-channel scattering signal was deleted and replaced by the left-channel scattering signal. The image became centralised, but it was still externalised reasonably well. Not so well as the original, however.
2. Both right-channel scattering and left-channel scattering were replaced by the average of the two. The image became centralised again, but it was still externalised.

The conclusion from this was that even monophonic scattering was sufficiently powerful to create an externalised sound image, although a more "correct" two-channel wave-scattering synthesis is preferred. Monophonic synthesis might be preferred if the available signal-processing capacity is small. (In time, it should be possible to create a composite system for both monophonic, LF, common-mode scattering, and also two-channel HF scattering; this might prove slightly more efficient than a full-bandwidth two-channel system.)

The overall conclusions for the use of wave-scattering for creating externalisation were as follows.

1. The gross, early reflections are unimportant.
2. By band-limiting the wave-scattering to below about 5 kHz, it should remain effective and be less complicated to synthesise.
3. The wave-scattering period must be tens of milliseconds or greater (say, 60 ms or more).
4. Monophonic wave-scattering is partially effective, although two-channel wave-scattering synthesis is preferred.

Figure 4:
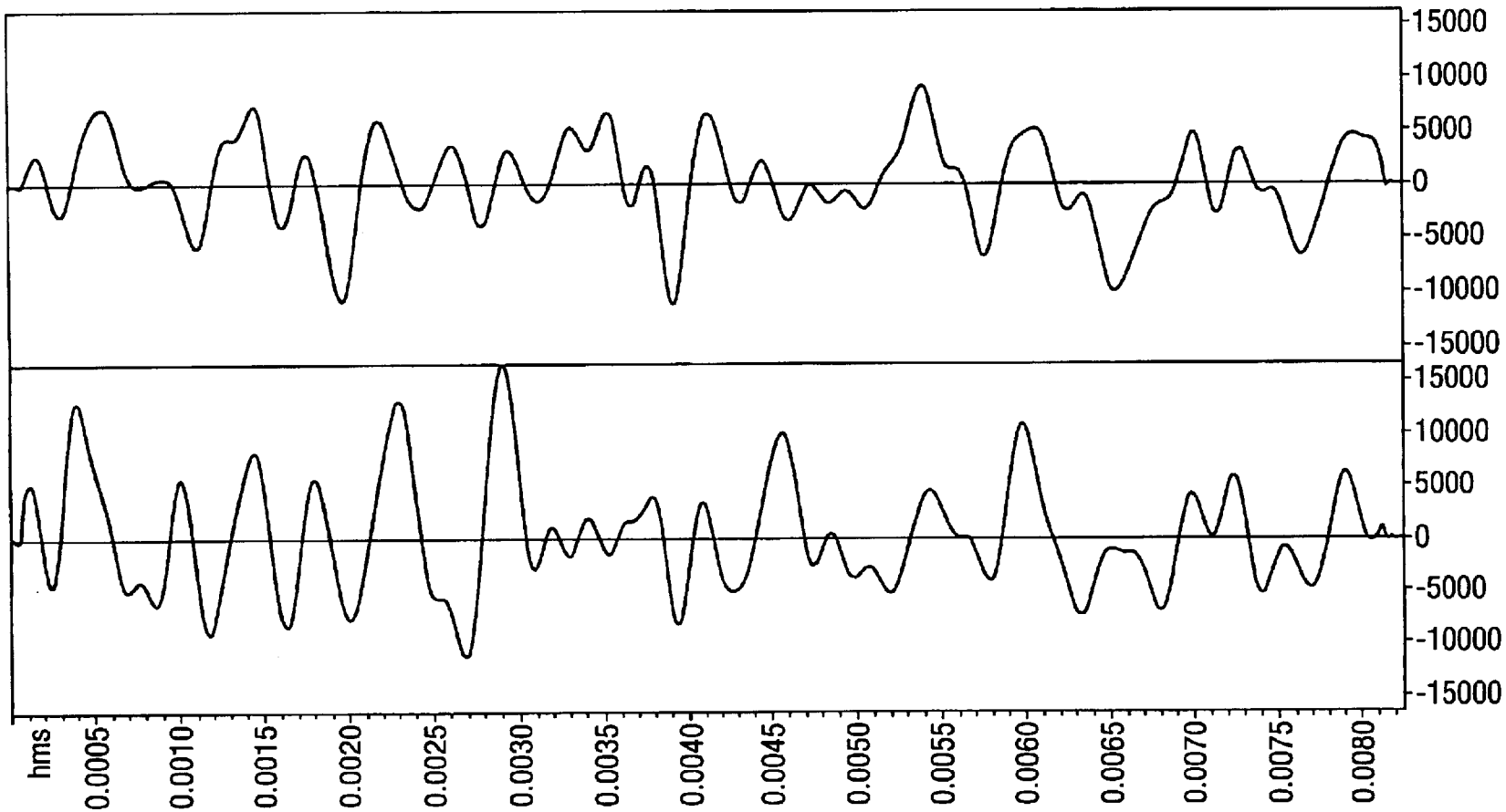
FIG. 4 shows an 8 ms part of the data of FIG. 3 which has been band-pass filtered.

Having ascertained these significant features of the wave-scattering signals, the next step was to find a means to synthesise the impulse response of a representative section of the data. Accordingly, the impulse sound-recording used for the above experiments was band-pass filtered (80 Hz to 5 kHz), and then a representative two-channel sample of the wave-scattering section of the signal was selected as an example. Referring to FIG. 3, it can be seen that the early stages of the scattering are dominated by the ground and ceiling reflections, and therefore are not representative of pure scattering data. The tail end of the scattering is unsuitable because it has a very small amplitude, and so it was decided to select an 8 ms period just after the scattering had become relatively consistent, beginning at around 14 ms. This "working" 8 ms sample of band-limited wave-scattering is shown in FIG. 4 (amplified for clarity).

Figure 5:
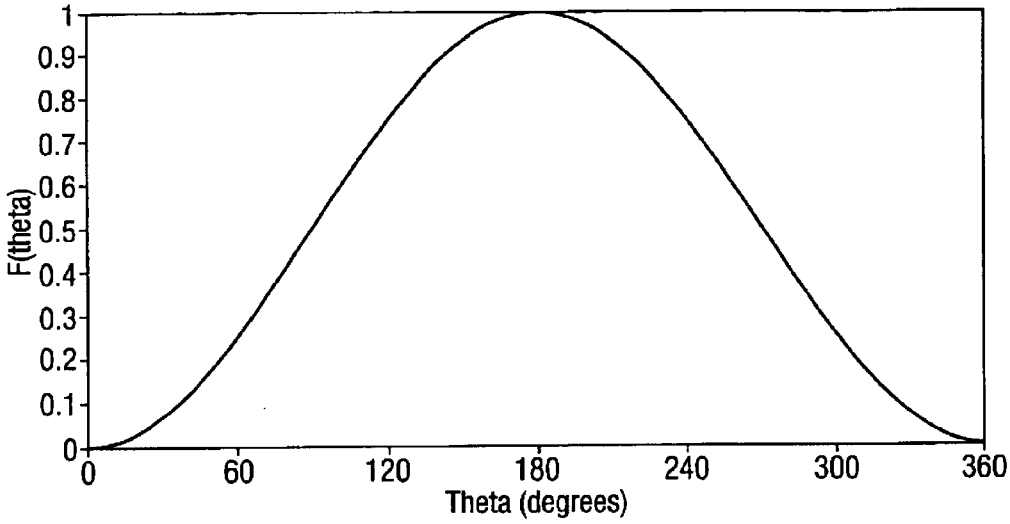
FIG. 5 shows a raised sine basis function.

The inventor's hypothesis was that a required section of impulse-response data of this nature could be constructed accurately from a number of small, elemental basis functions. However, even small, sudden, discontinuities in audio streams can create audible artefacts in the form of clicks or pops, and so the question arises as to what type of elemental function could be used for this purpose. There is one type of wave-shape which the inventor believed would be favourable for use in the invention, based on the sin θ function. By using the sine function for values of θ between −90° and +270°, and offsetting and halving the result so that it lies in the range 0 to +1, then a smooth, bell-shaped function with unit gain is created (sometimes known as the "raised sine" function). This function is unusual in that it possesses zero gradient at its minimum and maximum values, and so it should be capable of being introduced inaudibly at any point into an audio stream. The mathematical expression for this "ideal" generic basis function, depicted graphically in FIG. 5, is as follows.

$$F_{wavelet}(\theta) = \left\{\frac{1+\cos(\theta+180)}{2}\right\}_{\theta=0}^{\theta=360} \quad (1)$$

Furthermore, because of the zero-gradient "entrance" and "exit" feature of the function, many basis functions, or impulse "wavelets", of this type can be superposed on to each other to create more complex wave patterns in a smooth, predictable manner, without audible artefacts.

Strictly speaking, the term "wavelet" refers to a fragment of a waveform, rather than a section of an impulse response. However, the author cannot think of a better descriptor than "impulse-wavelet" at the moment, and so that term or the term "wavelet" will be used—albeit loosely—hereinafter to define an impulse-response or basis function of the form of equation (1).

Figure 6:
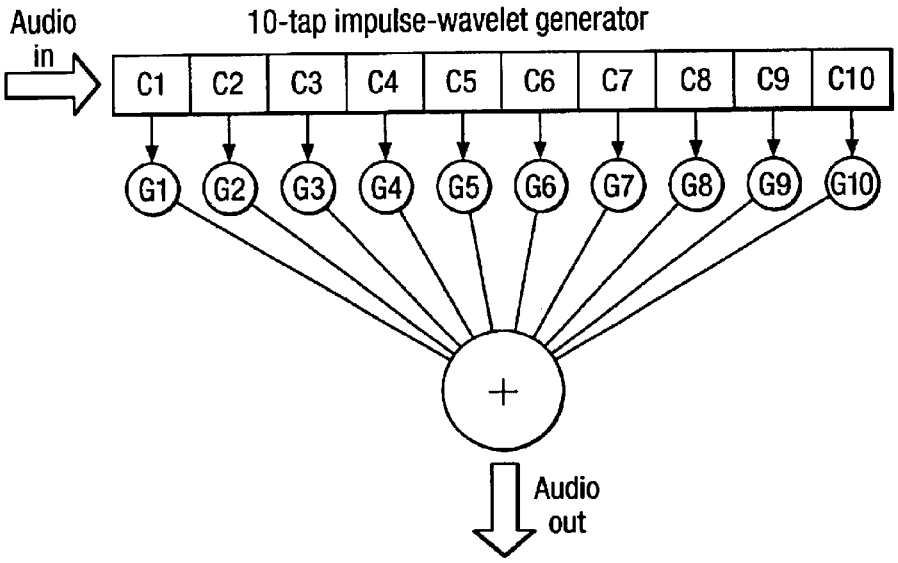
FIG. 6 shows a ten tap FIR filter.

The above basis function or impulse-wavelet can be created using an FIR-type structure, such as the 10-tap structure shown in FIG. 6, in which the tap coefficient values (gain values, G1 to G10) represent directly the function itself. As the audio data is transferred sample-by-sample through the cells of the filter (C1 to C10), at each stage the data value in each cell is multiplied by its associated tap value and fed to an accumulator which sums the contributions all together (as will be appreciated by those skilled in the art). If it were required to create a basis function or impulse-wavelet generator having this period (10 taps at 44.1 kHz is approximately 227 μs), then it would be first necessary to create a notional value of θ associated with each tap such that the function spanned the relevant time period. For an n-tap generator, this notional value of θ is given by:

$$\theta_{national} = \left\{\frac{360}{n+1}\right\} \quad (2)$$

(This expression defines a wavelet function without leading or trailing zeros, which would be redundant in a signal-processing system and would decrease its efficiency.) Data for a 10-tap impulse-wavelet generator are given in the table below, according to equations (1) and (2), above.

TABLE 1

Wavelet generator coefficients for a 10-tap device

| Tap number | θ° (notional) equation (2) | F(θ°) equation (1) |
|---|---|---|
| 1 | 33 | 0.08 |
| 2 | 65 | 0.29 |
| 3 | 98 | 0.57 |
| 4 | 131 | 0.83 |
| 5 | 164 | 0.98 |

TABLE 1-continued

Wavelet generator coefficients for a 10-tap device

| Tap number | θ° (notional) equation (2) | F(θ°) equation (1) |
|---|---|---|
| 6 | 196 | 0.98 |
| 7 | 229 | 0.83 |
| 8 | 262 | 0.57 |
| 9 | 295 | 0.29 |
| 10 | 327 | 0.08 |

When a unit impulse is fed into the 10-tap generator of FIG. 6, using the above coefficient data, it initially resides in cell 1, giving it a value of 1.0. There are zeros in the remaining cells, and so the output value of the accumulator is 0.08. In the next cycle, the 1.0 has moved to cell 2, and again, all other cells contain zeros, and hence the output is 0.29, and so on. When the impulse has been transferred the length of the generator (and out), then the time-dependent output from the generator is as shown in FIG. 5, but with a time axis (one sample period per tap) replacing the national θ axis according to columns 1 and 2 in Table 1. This impulse-wavelet or basis function can be manipulated in a number of ways, enabling the construction of a much larger and complex impulse response.

Figure 7:
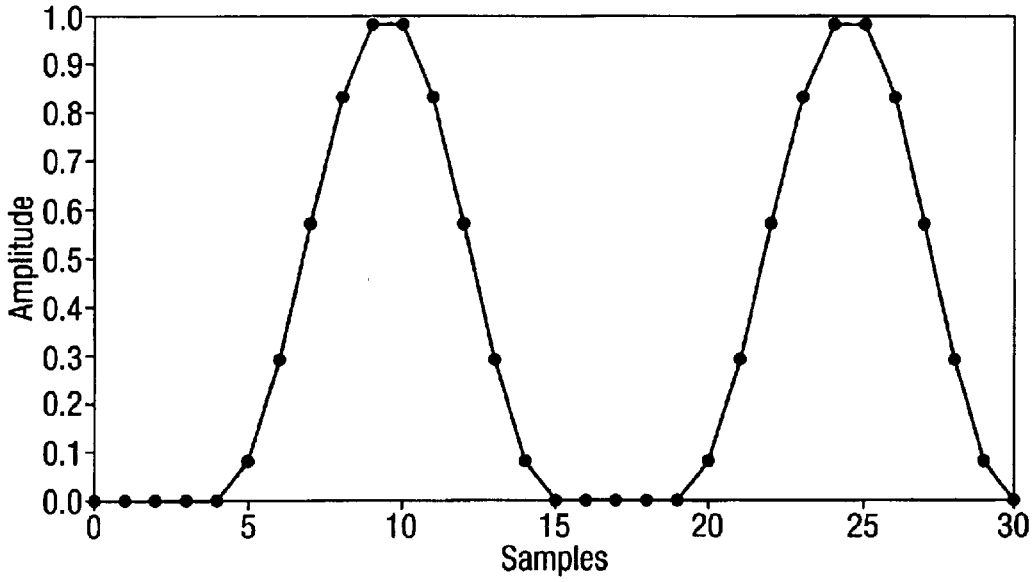
FIG. 7 shows the output of the filter of FIG. 6 having been triggered twice.

First, the impulse-wavelet can be "triggered" at different points in time simply by feeding appropriately time-delayed signals into the wavelet generator of FIG. 6. For example, FIG. 7 shows the output of a 10-tap generator, running at 44.1 kHz, having been fed a single impulse at t=5 samples and again at t=20 samples. The entire episode lasts for 30 samples (0.68 ms).

Figure 8:
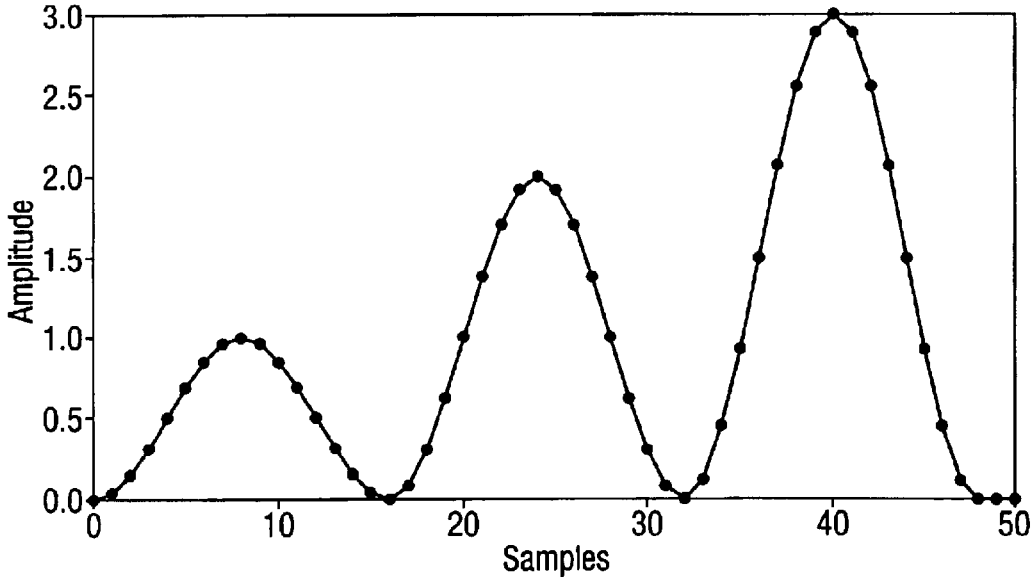
FIG. 8 shows the output of a 15 tap FIR filter having been triggered three times with different gain factors.

The next feature of the impulse-wavelet which can be manipulated is the magnitude of the output. This, of course, can be adjusted simply by scaling the coefficients, including the use of negative coefficients to create negative impulse responses. For example, FIG. 8 shows three, 15-tap impulse-wavelets triggered at t=1, t=17 and t=33 samples, and scaled successively so as to possess gain values of 1,2 and 3.

Figure 9:
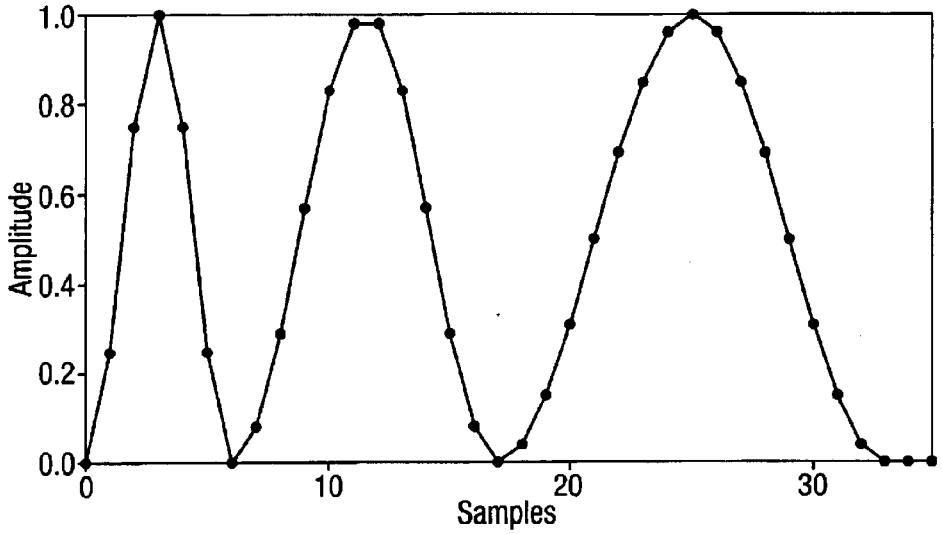
FIG. 9 shows the output of a 5 tap, 10 tap and 15 tap FIR filter triggered at different times.

The final parameter which can be adjusted is the overall duration of the impulse-wavelet. In the present invention, this enables the creation of a range of responses having differing periods, thus providing a flexible "toolkit" from which to construct a lengthier response. It seems likely that a sequence of FIR filters having numbers of taps in a geometric progression, such as for example having a sequence of binary-weighted wavelet generators, might be the best option, because this would allow a wide range of time-domain impulse structures to be constructed. For example, the simultaneous selective use of 5-tap, 10-tap, 20-tap and 40-tap generators. This is achieved simply by selecting the required time-period of the generator (and hence the number of taps), followed by the use of equation (2) to allocate the notional θ values to each tap, as been described, from which equation (1) defines the [unity-gain] coefficient. Examples of this are given in FIG. 9, which shows three successive impulse-wavelets or basis functions having an increasing duration of action. The first is a 5-tap impulse-wavelet, triggered at t=1, followed by 10-tap and 15-tap wavelets at t=7 and t=18 samples respectively.

Figure 10:
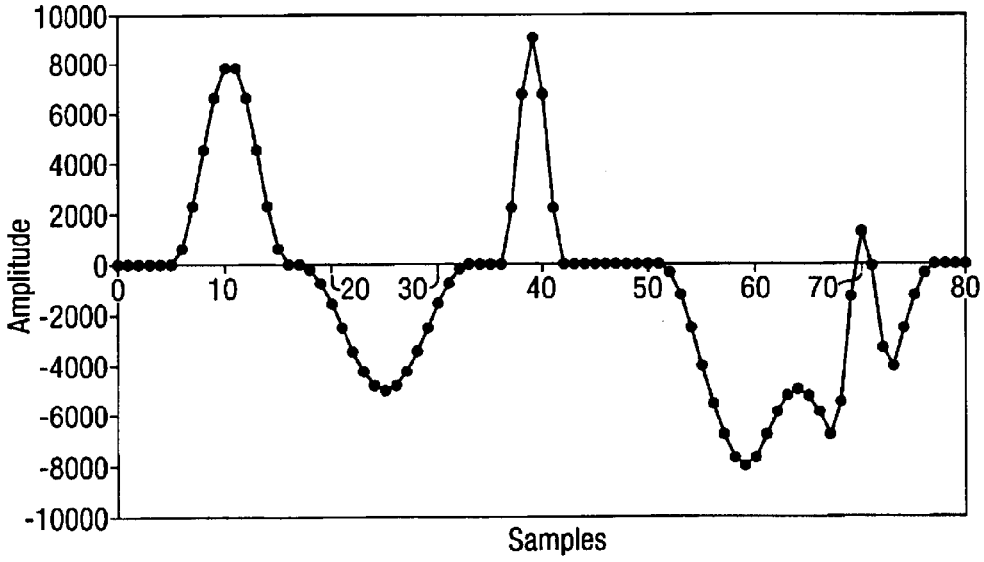
FIG. 10 shows a complex waveform generated by superposition of 6 basis functions generated by multi-tap FIR filters.

As an example of how a series of impulse-wavelets can be assembled to create a relatively lengthy and complex impulse response, FIG. 10 shows an arbitrary, complicated waveform which is 80 samples in length, but which was created using only 6 impulse-wavelets (of only three types: 5-tap, 10-tap and 15-taps). The rather complicated shape towards the latter part of the plot indicates how well the chosen wavelet function deploys in combinations for fitting to random curves. The data for this construction is given below in Table 2.

TABLE 2

Impulse-wavelet data for the waveform of FIG. 10

| wavelet number | wavelet-type (number of taps) | amplitude | trigger point (samples) |
|---|---|---|---|
| 1 | 10 | 8000 | 6 |
| 2 | 15 | −5000 | 18 |
| 3 | 5 | 9000 | 37 |
| 4 | 15 | −8000 | 52 |
| 5 | 15 | −8000 | 62 |
| 6 | 5 | 9000 | 68 |

Figure 11:
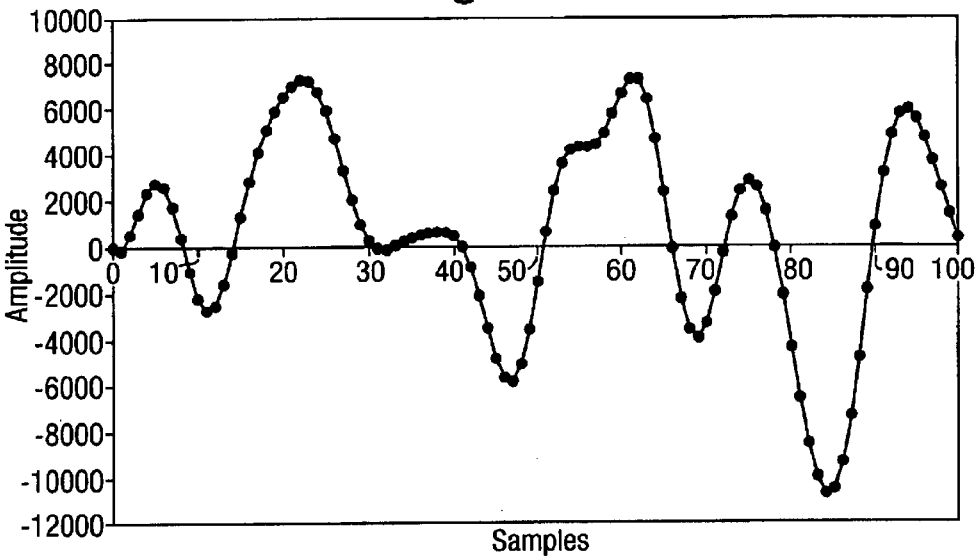
FIG. 11 shows the left hand channel data of FIG. 4.

The next step is to inspect part of the "working" benchmark impulse waveform of FIG. 4 in order to see what lengths of impulse-wavelet could be used to synthesise it. Accordingly, the audio .WAV file was saved in text format, and transfered to a spreadsheet (from which the following plots were derived). The first section of the left-hand channel of the benchmark impulse recording of FIG. 4 is shown in FIG. 11. After visual inspection, it seemed that the structure could be made up from only three basis functions or wavelet types, having 5-taps, 10-taps and 15-taps.

Figure 12:
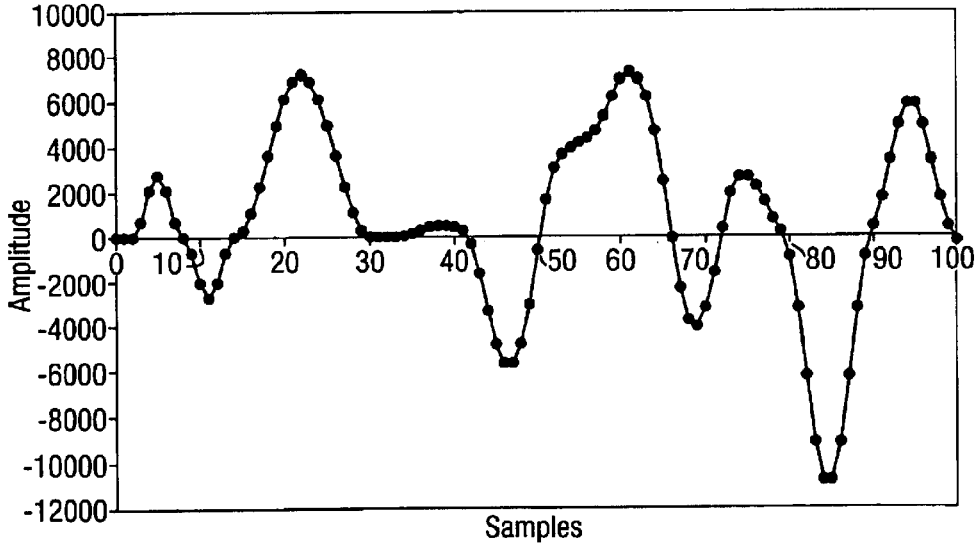
FIG. 12 shows the result of a manual fit to the curve of FIG. 11 using a superposition of the outputs from 3 multi-tap filters having different numbers of taps.
Figure 13:
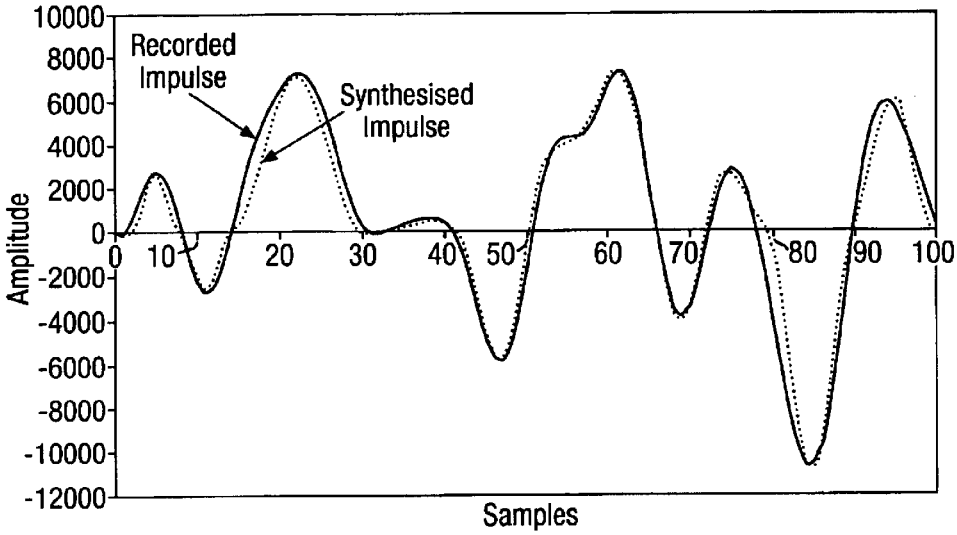
FIG. 13 shows the graphs of FIGS. 11 and 12 together for comparison.
Figure 17:
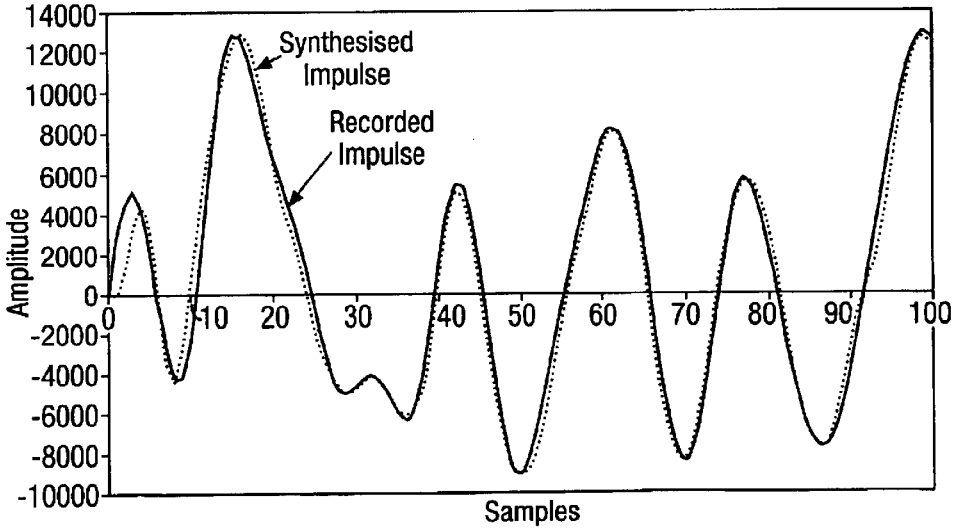
FIG. 17 shows a comparison between measured and synthesised part impulse response signals for the right channel.

By adding the data for three unity-gain impulse-wavelet generators of 5, 10 and 15 taps to the spreadsheet, it was possible to create columns to initiate any or all of the three generators at any elapsed time, and sum the outputs together. This wavelet-generator summation was plotted together with the real data as a function of elapsed time (from 1 to 100 samples in the first instance), and then coefficients were added to the appropriate columns in order to fit, visually, the sum of the three wavelet generators to the real, recorded data. This proved surprisingly easy to do; the results shown in FIG. 12. Note that there is a very close fit to the original, recorded data, as shown in FIG. 13, which overlays the plot of the wavelet synthesised data (light grey) on to the recorded data (black). The data-fitting process was continued for the remaining 256 or so samples of the 8 ms recording, and then the process was repeated for the right-hand channel. The data for the left-channel is given in Table 3, and the right-channel data is given in Table 4 (and shown in FIG. 17). (The ideal right-channel fitting took 47 wavelets, rather than the 43 of the left channel, but this the fit could easily be reduced to 43 too, simply by omitting the four least significant (smallest amplitude) wavelets (nos. 17, 21, 32 and 38)).

TABLE 3

Impulse-wavelet data for synthesis of the left-channel of FIG. 4.

| wavelet number | wavelet-type (number of taps) | amplitude | trigger point (elapsed samples) |
|---|---|---|---|
| 1 | 5 | 2800 | 3 |
| 2 | 5 | −2700 | 9 |
| 3 | 15 | 7200 | 15 |
| 4 | 10 | 500 | 34 |
| 5 | 10 | −5800 | 42 |
| 6 | 10 | 3700 | 49 |
| 7 | 15 | 7300 | 54 |
| 8 | 10 | −4100 | 64 |
| 9 | 10 | 2700 | 70 |

TABLE 3-continued

Impulse-wavelet data for synthesis of the left-channel of FIG. 4.

| wavelet number | wavelet-type (number of taps) | amplitude | trigger point (elapsed samples) |
|---|---|---|---|
| 10 | 10 | −11000 | 80 |
| 11 | 10 | 6000 | 90 |
| 12 | 10 | −2200 | 100 |
| 13 | 10 | 3800 | 108 |
| 14 | 10 | −3800 | 116 |
| 15 | 10 | 3100 | 123 |
| 16 | 10 | −1400 | 130 |
| 17 | 15 | 5200 | 137 |
| 18 | 10 | 6700 | 148 |
| 19 | 5 | −2000 | 157 |
| 20 | 5 | 1700 | 161 |
| 21 | 10 | −11100 | 165 |
| 22 | 10 | 6600 | 175 |
| 23 | 5 | −1800 | 186 |
| 24 | 5 | 2000 | 192 |
| 25 | 10 | −3300 | 196 |
| 26 | 10 | −1700 | 208 |
| 27 | 10 | −2100 | 216 |
| 28 | 15 | 3000 | 223 |
| 29 | 10 | 8500 | 231 |
| 30 | 10 | 1800 | 237 |
| 31 | 10 | −6700 | 247 |
| 32 | 15 | 5300 | 256 |
| 33 | 10 | −2400 | 269 |
| 34 | 15 | −9000 | 277 |
| 35 | 15 | −6000 | 284 |
| 36 | 5 | −1800 | 297 |
| 37 | 10 | 4700 | 302 |
| 38 | 5 | −2700 | 311 |
| 39 | 5 | 3200 | 317 |
| 40 | 5 | −900 | 323 |
| 41 | 15 | −6500 | 328 |
| 42 | 15 | 3800 | 341 |
| 43 | 10 | 1400 | 346 |

TABLE 4

Impulse-wavelet data for synthesis of the right-channel of FIG. 4

| wavelet number | wavelet-type (number of taps) | amplitude | trigger point (elapsed samples) |
|---|---|---|---|
| 1 | 5 | 4500 | 2 |
| 2 | 5 | −4400 | 6 |
| 3 | 15 | 13000 | 9 |
| 4 | 5 | 2000 | 21 |
| 5 | 15 | −5000 | 22 |
| 6 | 10 | −6100 | 32 |
| 7 | 10 | 5300 | 38 |
| 8 | 15 | −9000 | 43 |
| 9 | 10 | 2200 | 52 |
| 10 | 10 | 8100 | 57 |
| 11 | 10 | −8400 | 65 |
| 12 | 10 | 5700 | 73 |
| 13 | 5 | −2200 | 81 |
| 14 | 10 | −7700 | 82 |
| 15 | 15 | 12900 | 92 |
| 16 | 10 | −5000 | 104 |
| 17 | 5 | −400 | 106 |
| 18 | 15 | −11000 | 109 |
| 19 | 15 | 16400 | 119 |
| 20 | 10 | −2900 | 129 |
| 21 | 5 | 1000 | 136 |
| 22 | 5 | −1800 | 141 |
| 23 | 5 | 1700 | 146 |
| 24 | 5 | −1500 | 151 |
| 25 | 15 | 1600 | 154 |
| 26 | 10 | 2500 | 160 |
| 27 | 10 | −8200 | 167 |
| 28 | 5 | 3000 | 176 |

TABLE 4-continued

Impulse-wavelet data for synthesis of the right-channel of FIG. 4

| wavelet number | wavelet-type (number of taps) | amplitude | trigger point (elapsed samples) |
|---|---|---|---|
| 29 | 15 | −5200 | 179 |
| 30 | 15 | 9800 | 192 |
| 31 | 10 | −2700 | 202 |
| 32 | 5 | 600 | 209 |
| 33 | 10 | −3800 | 213 |
| 34 | 15 | −5400 | 219 |
| 35 | 15 | 4400 | 230 |
| 36 | 10 | −4100 | 248 |
| 37 | 15 | 10500 | 255 |
| 38 | 15 | −7400 | 270 |
| 39 | 10 | −1300 | 282 |
| 40 | 15 | −6800 | 290 |
| 41 | 10 | 4100 | 301 |
| 42 | 10 | 5900 | 312 |
| 43 | 10 | −5400 | 320 |
| 44 | 5 | −1800 | 330 |
| 45 | 10 | −4800 | 332 |
| 46 | 15 | 6500 | 340 |
| 47 | 10 | −1500 | 346 |

The important outcome is that this simulation process is very efficient. The left channel, say, uses the equivalent of only 73 taps of filtering to simulate the recorded 8 ms impulse response. (30 for all three wavelet generators, plus 43 for the initiation points.) Ordinarily, it would require many more taps than this to replicate the 8 ms impulse response; at 44.1 kHz it would require 8×44.1=353 taps.

It will be appreciated that the benchmark data here of FIG. 4 is one typical example only, taken at random. It is somewhat imperfect in the sense that the far-ear (RHS) envelope amplitude is greater in magnitude than the near-ear data, simply because the near-ear scattering episodes originated more closely because of physical factors, and so they were already in "decay mode" during the period of the data, whereas the far-ear scattering objects were more distant, and still generating a strong scattering component during the time period of the sample (from 14 to 22 ms after the direct sound). The scattering data can be adjusted in several ways in order to offset these and other effects, and thus provide optimum results. For example, either one or both channels of the data can be increased or decreased, if required, by the use of a simple, constant scaling factor. Alternatively, it is possible to ensure gradual exponential reduction of the data, for smooth "decay", by applying a time-dependent exponential factor to the data coefficients, as will be described later. This would be useful if only a steady-state portion of scattering data was available for basing the synthesis on. Another adjustment which is worthwhile is to compensate for any overall zero-offset in the finally fitted coefficients, as will be obvious to those skilled in the art.

It was decided that the 8 ms event, above, was a sufficiently long period of wave-scattering to attempt reiterative sequencing, because if this pattern could be repeated several times, then the requisite tens of milliseconds of turbulence could be created. In order to test this possibility, the working recording of the impulse was investigated further. First, the wave-scattering section (14 to 21 ms) used for the above (FIG. 4) was stored, and then all the wave-scattering signal was deleted. Next, the stored 8 ms section was re-introduced, beginning about 3 ms after the direct arrival, and it was repeated five times in succession. An exponential fade was applied to this new, artificial wave-scattering region, so as to simulate the natural decay. The entire waveform was now visually similar to the original (FIGS. 2 and 3). However, when it was auditioned, although the externalisation of the impulse sound was pleasingly intact, there was an unpleasant "flutter" artefact: the regular repetitive use of the same section of the impulse response was audible. In an attempt to overcome this, the exercise was repeated, but an arbitrary, irregular series of overlaps was used, with block 2 beginning at 7 ms, block 3 at 11 ms, block 4 at 17 ms, and block 5 at 25 ms (and ending, of course at 33 ms). This was very successful in reducing the flutter artefact. It was judged that this 33 ms sequence was now sufficiently long that it could be repeated at least once (corresponding to a feedback loop, as will be described below). This was tested, and was found to be successful, too. If this additional stage is taken into consideration (including one single feedback cycle), then the invention is synthesising 66 ms of turbulent data using the equivalent of only 79 taps (i.e. 30 for all three wavelet generators, plus 43 for the initiation points, 5 for the irregular sequencing and 1 for the feedback). Ordinarily, it would require many more taps than this to replicate the 66 ms impulse response. At 44.1 kHz, it would require 66×44.1=2,911 taps, and hence the efficiency ratio is about 37:1. The invention is thirty-seven times more powerful than conventional methods, for the cited example.

Figure 14:
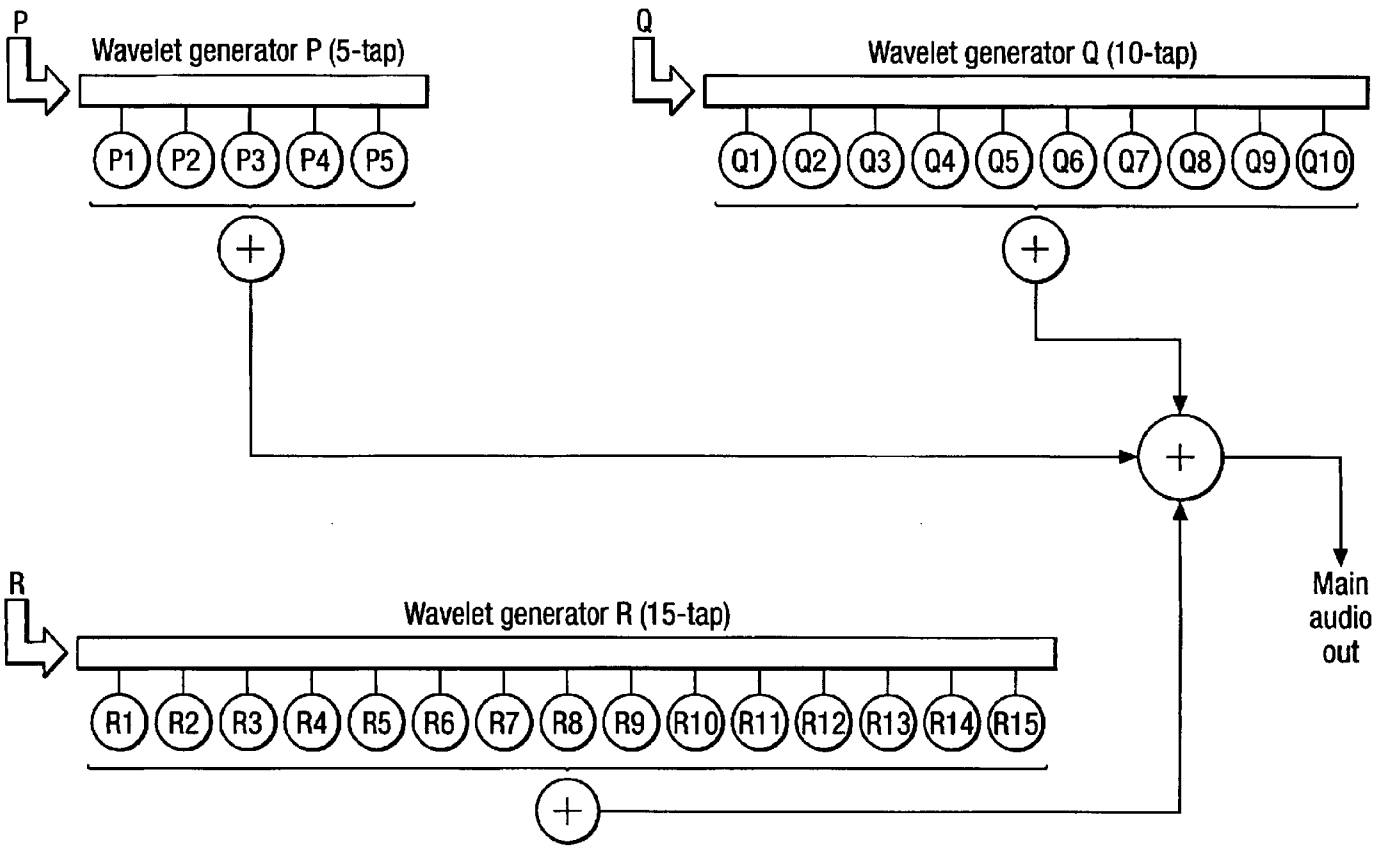
FIG. 14 shows a diagram of the layout of 3 multi-tap FIR filters used to generate the data of FIG. 12.
Figure 15:
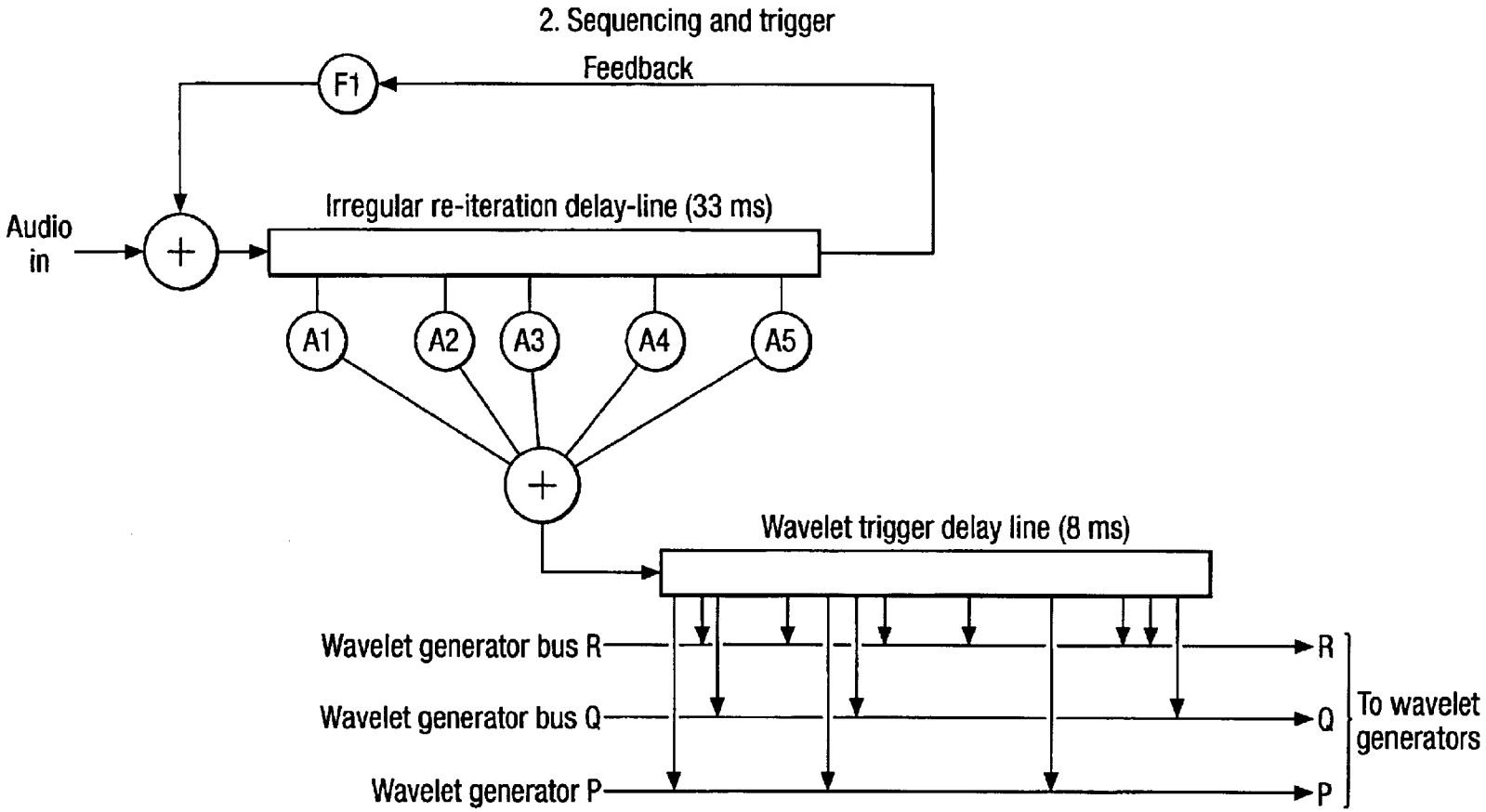
FIG. 15 shows a diagram of an embodiment of a sequencing and triggering sub-system.
Figure 16:
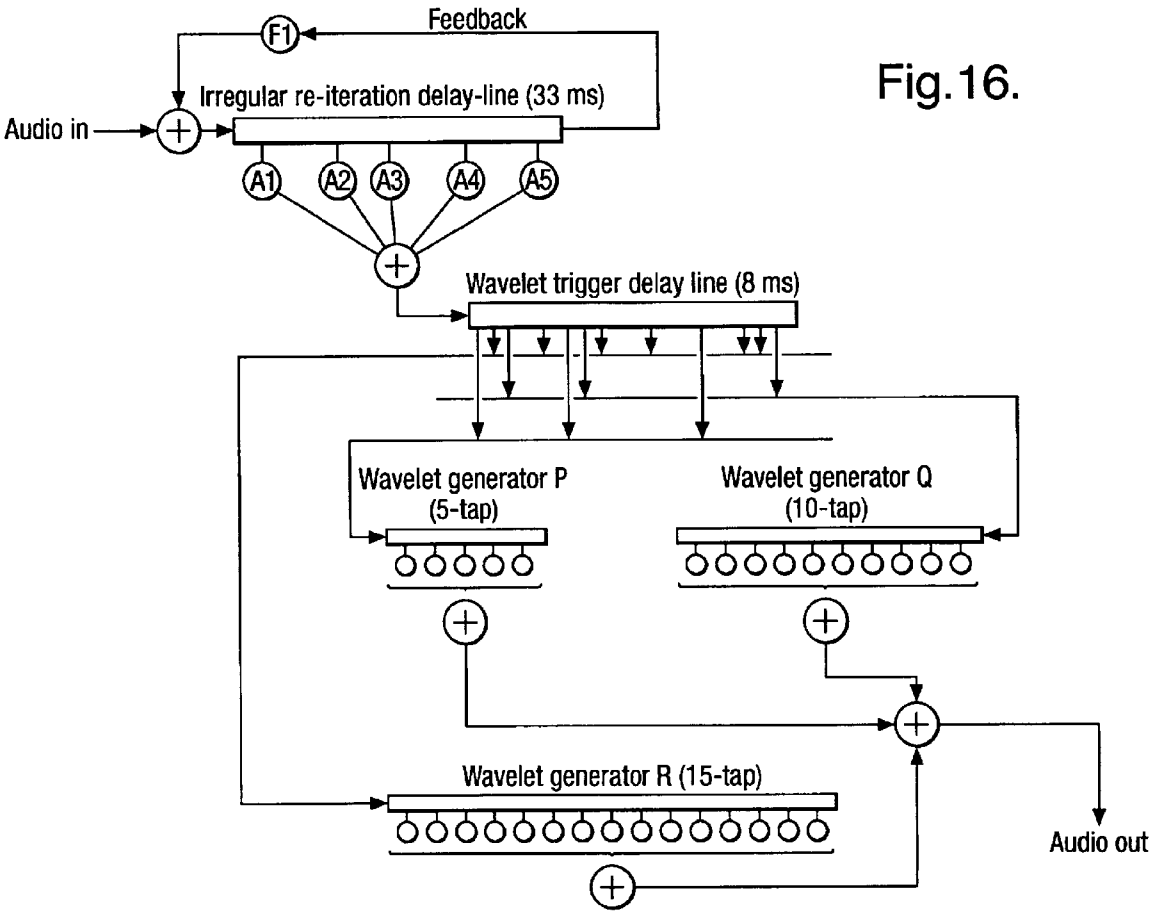
FIG. 16 shows how FIGS. 14 and 15 would be combined in practice.

This signal-processing architecture is depicted in FIGS. 14, 15 and 16, and which will now be referred to as a "Wavelet Engine". It comprises four major elements: (a) wavelet generator array (triple); (b) wavelet-trigger sequencer; (c) irregular re-iteration sequencer; and (d) feedback loop.

(a) Wavelet Generator Array

FIG. 14 shows a triple impulse-wavelet generator array, featuring 5-tap, 10-tap and 15-tap generators (P, Q and R respectively) according to FIG. 6 and its associated description. Each generator has its own individual input, and the outputs of the three generators are summed together to create the final audio output stream.

(b) Wavelet-trigger Sequencer

FIG. 15 (lowermost) shows the wavelet trigger sequencer, in the form of a tapped delay-line (73 taps; 8 ms long). Audio samples are fed into the line which is tapped according to the data in Table 3 (right-hand column), each tap feeding a particular multiplier (not shown explicitly) according to the values in the third column, and then this is fed to the appropriate impulse-wavelet generator (P, Q or R) in the array, via a respective common bus, as indicated by column 2, which sums the data from all of the taps which feed it.

(c) Irregular Re-iteration Sequencer

This is shown uppermost in FIG. 15, and is also a tapped delay line, being 33 ms long and having 4 taps (excluding the t=0 tap) at 7 ms, 11 ms, 17 ms and 25 ms. Each tap feeds a multiplier to attenuate the signal according to an exponential attenuation as a function of elapsed time (below). The output of all of five taps is summed and fed into the wavelet trigger sequencer, thus creating the irregular repetition of the 8 ms synthesised blocks.

(d) Feedback Loop

The feedback loop comprises a single path from the output of the irregular re-iteration delay-line (t=33 ms) back to the audio input, via an attenuator (F1) chosen to represent a time-related exponential attenuation.

At this point it is necessary to consider the overall nature and shape of the wave-scattering envelope, especially with respect to the onset and decay of wave-scattering.

If the waveforms of FIGS. 2 and 3 are examined, it can be seen that the onset of wave-scattering is almost immediate, following the direct signal within a millisecond or two. The turbulent nature of the scattered signal is clearly beginning to be visible at about the time of the two reflections from the ceiling and ground, at about 2.0 and 3.5 ms respectively. This is entirely as one would expect because of path-length considerations. However, it is difficult to assign a particular time or specific onset envelope to the scattered waves, and so the question arises about how to implement this in the impulse-wavelet engine: whether to fade-in the scattering, or activate the scattering without a fade-in.

It is simpler and efficient to omit simulation of these first early reflections, which, as described above, are not at all significant for externalisation when monitoring via headphones. If the scattering is enabled without fade-in, beginning several milliseconds after the direct sound, then the rapid onset of the synthesised scattering appears to take the place of the first reflections, and produces an excellent result. This achieves two goals at once: eliminating the need for: (a) early reflection simulation; and (b) scattering fade-in.

Although, as stated, fade-in can be omitted, it is nevertheless a useful option to have. Under "extreme" evaluation conditions, for example comparing a recorded impulse with a synthesised impulse (with wave-scattering), then the use of a fade-in over a period of several milliseconds can produce a slightly more realistic sound. Bear in mind that this synthesis was devoid of simulated reflections (i.e. comprising only direct-sound 3D placement and its associated scattering), and so was not absolutely true to reality in this respect. It was undertaken purely to evaluate and optimise the wave-scattering effects.

Figure 15B:
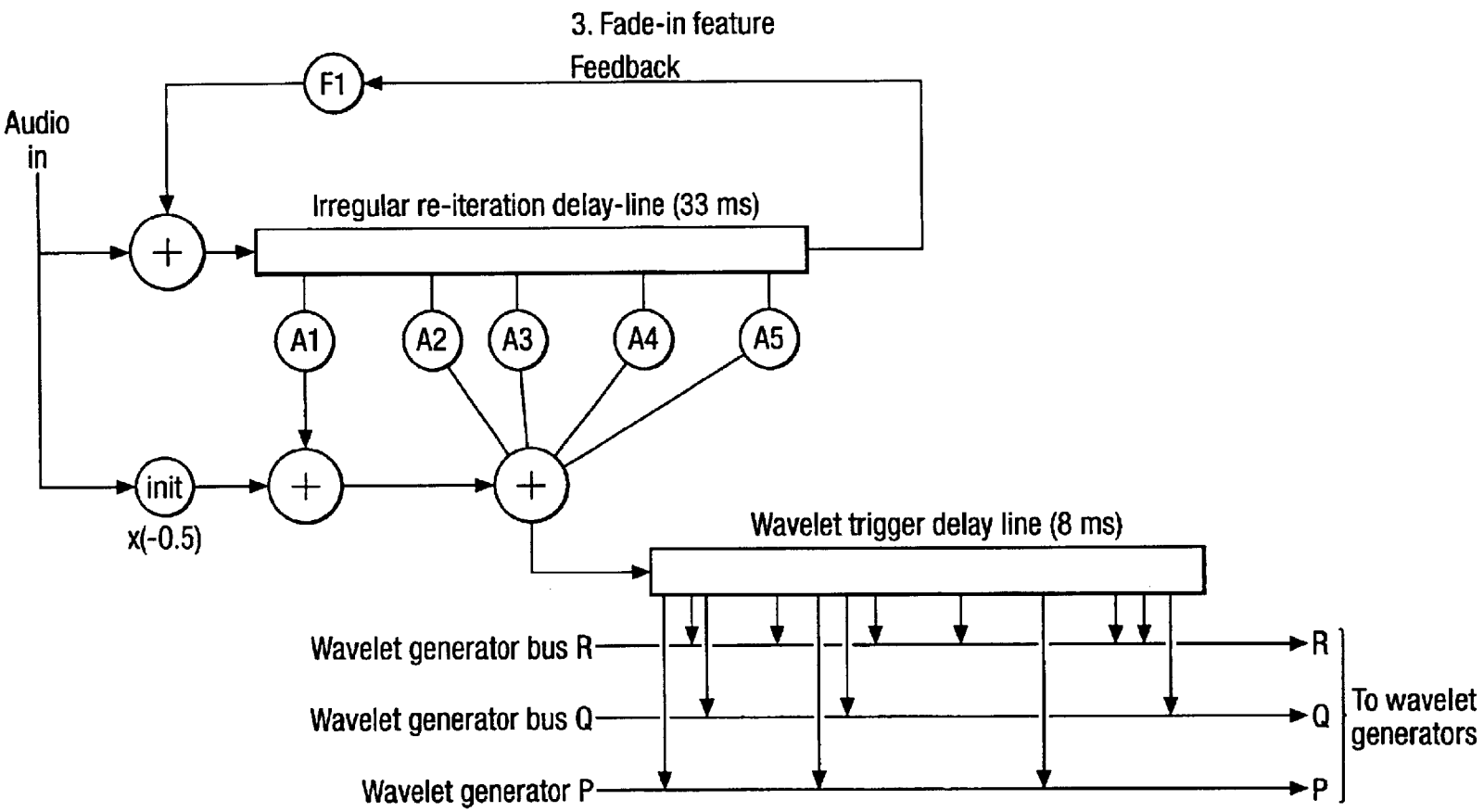

A crude fade-in of the scattered signal can be accomplished by a small refinement of FIG. 15, as shown in FIG. 15B. It requires (a) the addition of a new summing node between the very first output of the irregular re-iteration delay line, after attenuator A1, and the first summing node into which it would normally feed; and (b) a feed directly from the audio input via a new inverting attenuator, "init", which also feeds the new summing node. Typically, the transfer function of the inverting attenuator "init" might be, for example, −0.5.

This alternative embodiment operates as follows. Consider a single, unit impulse arriving at the audio input of the engine. Without the refinement, it propagates directly via the first tap (because this tap is at t=0), having gain A1=1 into the wavelet trigger delay-line, thus creating the first batch of wavelets, the first 8 ms of scattered wave data, with unit gain. When it has traversed the re-iteration delay line to tap number 2, the impulse triggers the second batch of wavelets, having gain=A2, and so on. When the impulse reaches the end of the re-iteration delay-line (having triggered all five batches of wavelets) it is fed back to the input via an attenuator, F1, to regenerate the cycle, this time at a reduced level, and so on. In summary, then, the wavelet batches have gain factors according to Table 5, below.

TABLE 5

Gain values of the wavelet batches without refinement

| wavelet batch | batch gains during first cycle (prior to feedback) | batch gains during second cycle (after feedback) | batch gains during third cycle (after feedback × 2) |
|---|---|---|---|
| 1 | A1 | A1 × F1 | A1 × F1 × F1 |
| 2 | A2 | A2 × F1 | A2 × F1 × F1 |
| 3 | A3 | A3 × F1 | A3 × F1 × F1 |
| 4 | A4 | A4 × F1 | A4 × F1 × F1 |
| 5 | A5 | A5 × F1 | A5 × F1 × F1 |

Note that the very first batch (0 to 8 ms) has the maximum gain of all the batches. Now consider the situation with the described refinement in place. Again, first consider the single, unit impulse arriving at the audio input of the engine. It propagates directly via the first tap (because this tap is at t=0), having gain A1=1 into the new summing node, but it also propagates via the inverting attenuator "init" into the same node. The output of the summing node is hence ({1×A1}+{1×−(init)}). For example, if the inverting attenuator is given a transfer function of −0.5, then the impulse travelling via A1 arrives at the summing node with a gain of A1 (i.e.=1), but the impulse travelling via the inverting attenuator arrives at the node with a gain of −0.5. The output of the node is hence 1−0.5=+0.5. This attenuates the first—and only the first—impulse into the wavelet trigger delay line by a factor of 50%. However, the impulse propagating along the irregular re-iteration delay line is still unity gain. When it exits the end of the re-iterative delay line and is fed-back to its input via F1, the initial signal via "init" is not present, and hence the gain of the first wavelet batch of the second cycle is (A1×F1), just as it would be without the refinement. Consequently, the fade-in effect does not interfere with the smooth exponential decay of the signal at this point (t=33 ms); it is present only during the initial batch of the first cycle. With the fade-in refinement in place, the wavelet batches have gain factors according to Table 6, below.

TABLE 6

Gain values of the wavelet batches with "fade-in" refinement

| wavelet batch | batch gains during first cycle (prior to feedback) | batch gains during second cycle (after feedback) | batch gains during third cycle (after feedback × 2) |
|---|---|---|---|
| 1 | A1 × (1 − init) | A1 × F1 | A1 × F1 × F1 |
| 2 | A2 | A2 × F1 | A2 × F1 × F1 |
| 3 | A3 | A3 × F1 | A3 × F1 × F1 |
| 4 | A4 | A4 × F1 | A4 × F1 × F1 |
| 5 | A5 | A5 × F1 | A5 × F1 × F1 |

Table 6: Gain Values of the Wavelet Batches with "Fade-in" Refinement

It is important that the scattering signal diminishes with time, preferably in an exponential manner, corresponding to the reduction of the original signal intensity as the wavefront expands and occupies a larger surface. Also, of course, there is some energy absorbed as the acoustical waves interact with the scattering objects and surfaces. The envelope of the scattered-wave data is dependent, therefore, on the nature of the scattering bodies, their proximity to the source and listener, and so on, and consequently the time-constant associated with the exponential decay will vary according to acoustical circumstances.

Once again, after inspection of the waveforms of FIGS. 2 and 3, the exponential nature of the wave-scattering decay is clear. By varying the time-constant, different spatial effects can be achieved, and so the actual value chosen is not a critical feature. Indeed, different users might prefer different values. However, it is important to be consistent with the time-constant in the calculation of the various attenuation factors of time-delayed signal blocks, in order to achieve a smooth, progressive apparent decay.

A general expression for the amplitude of the envelope of the scattered signal as a function of time, $A_t$, and $A_0$, its value at t=0, can be written thus:

$$A_t = A_0 e^{-\alpha_t t} \quad (3)$$

From FIG. 3, it can be seen that the wave-scattering amplitude halves during a period of about 10 ms. Hence, if $A_t$ is 50% of $A_0$ after 10 ms, then the value of alpha is calculated to be 0.69 $s^{-1}$. With this particular time-constant selected, it is now possible to calculate the attenuation factors for all of the time-delayed signal blocks using equation (3) and $\alpha$=0.69 $s^{-1}$. The relevant attenuators are those of the irregular re-iteration delay line (A1 to A5 in FIG. 15), and the overall feedback attenuator, F1 (FIG. 15). The related time-delays and calculated gain coefficients are as follows.

TABLE 7

Gain coefficients for time-delayed elements based on 10 ms half-life

| tap number | associated time-delay (ms) | gain coefficient equation (2) |
|---|---|---|
| A1 | 0 | 1.0000 |
| A2 | 7 | 0.6169 |
| A3 | 11 | 0.4681 |
| A4 | 17 | 0.3094 |
| A5 | 25 | 0.1782 |
| F1 | 33 | 0.1026 |

The entire wavelet engine (without the fade-in refinement) is shown in one block diagram, for clarity, in FIG. 16. The direct audio signal is time-delayed by several milliseconds (not shown), and fed via a first summing node into the irregular re-iteration time-delay line, from which it is fed into a second summing node immediately via the first shown tap and A1, and then again after 4 time intervals from the other taps via their associated gain-coefficients (A2 to A5). The output from the irregular re-iteration time-delay line is fed back to the first summing node via attenuator F1, so as to provide a regenerative pathway. The output from the second summing node is fed into a wavelet trigger delay-line. This is configured so as to feed an array of three different impulse-wavelet generators, according to a pre-programmed pattern based on wave-scattering data. Output from the wavelet generators is summed together in a final node, from which the signal is fed away to be combined (not shown) with the original, direct audio signal according to our co-pending patent application.

Figure 18:
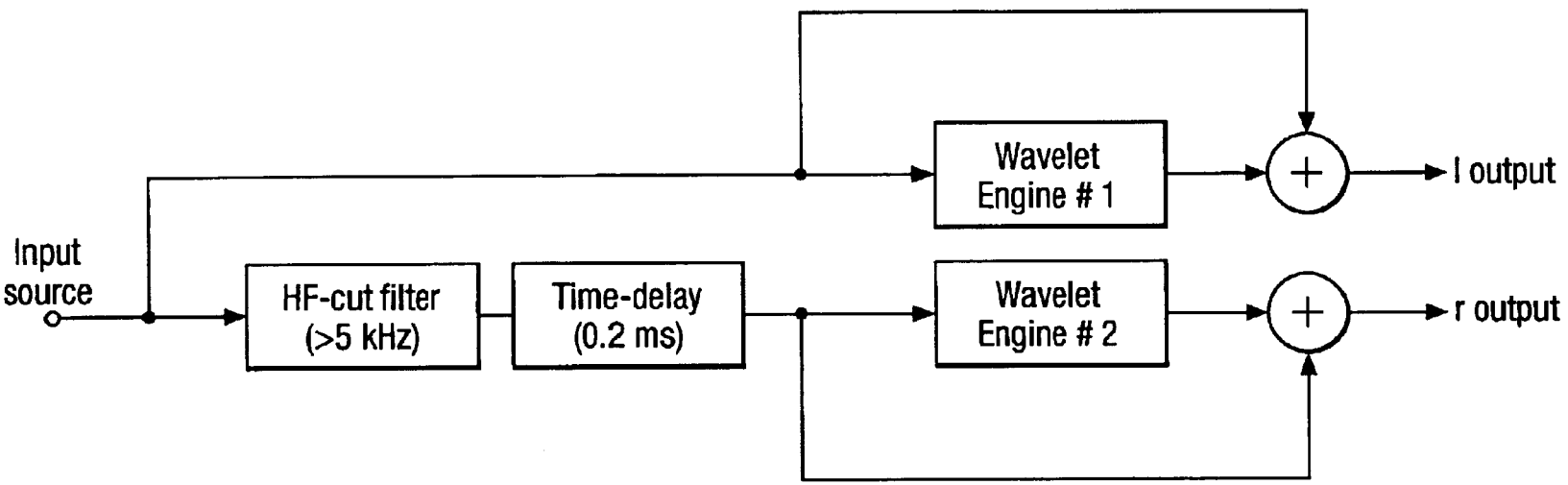
FIG. 18 shows a diagram illustrating how the present invention can be used to create an externalised headphone image.

It has been discovered that the invention is so effective that it can achieve forward externalisation of the headphone image without the use of HRTF processing. This can be achieved as shown in FIG. 18, in which a monophonic source is split into two signals, one of which is subjected to a 0.2 ms time delay and a high-cut filter (rolling off above, say, 5 kHz). This latter is a very crude simplification of the far-ear inter-aural time-delay and spectral shaping of a 30° azimuth HRTF. Next, both signals are fed into a pair of impulse-wavelet engines according to FIG. 16, one using Table 3 left-channel data, and the other using associated right-channel data. There is a direct sound path in parallel with the wavelet engines. When the results are auditioned on headphones, the image is forward positioned, at about 30° azimuth, and it is very well externalised. This is remarkable because it enables HRTF-free virtualisation to be achieved using relatively small amounts of signal processing power, and provides a result which is "tone-neutral", without the inevitable mid-range tonal boost that HRTF processing confers. This is described in more detail in our co-pending patent application.

The invention is well-suited to the provision of audio wave-scattering effects for virtualisation in cell-phones, as described in co-pending patent application number GB 0009287.4, because of its efficiency.

The invention can be included readily in conventional reverberation systems to provide a smoother and more natural sound. This would be simple to implement: the wavelet engine would simply act as a pre-processor prior to the reverberation engine. In a more sophisticated version, the invention can be used in feedback lines and cross-feed elements. In the most simple implementation, a single wavelet generator, such as one of the three of FIG. 14, is used as a reverb pre-processor.

The various parameters of the Wavelet Engine can be modified and adjusted in real-time operation, to form an interactive system for use in computer games, for example.

The wavelet engine can be supplied with a range of pre-set parameter sets, corresponding to a range of acoustic conditions (in the same way that reverberation units have pre-set options).

The invention is efficient enough, in terms of signal-processing requirements, to be built into present-technology personal stereo players (MiniDisc, MP3, CD and so on). The invention is also efficient enough to be built into present-technology electronic musical instruments (keyboard, wind-instruments, violins and the like) for "silent" practice using headphones.

Although the invention described above was intended for the synthesis of wave-scattering effects, in which a lengthy impulse response is required, the invention can also be applied to HRTF processing, where it enables a considerable reduction in signal-processing power to be achieved. This is effected simply by the use of appropriate length wavelet (or basis function) generators. In practise, an HRTF comprises two FIR filter blocks, typically between 25 and 100 taps in length, and a time-delay line (up to 680 $\mu$s; about 30 samples at 44.1 kHz sampling rate). An embodiment of the present invention replaces each FIR filter block with a wavelet generating engine as described above, with the advantage that the wavelet generator elements are common to a plurality of HRTFs, and so only one tapped triggering delay-line is required per block.

Figure 19:
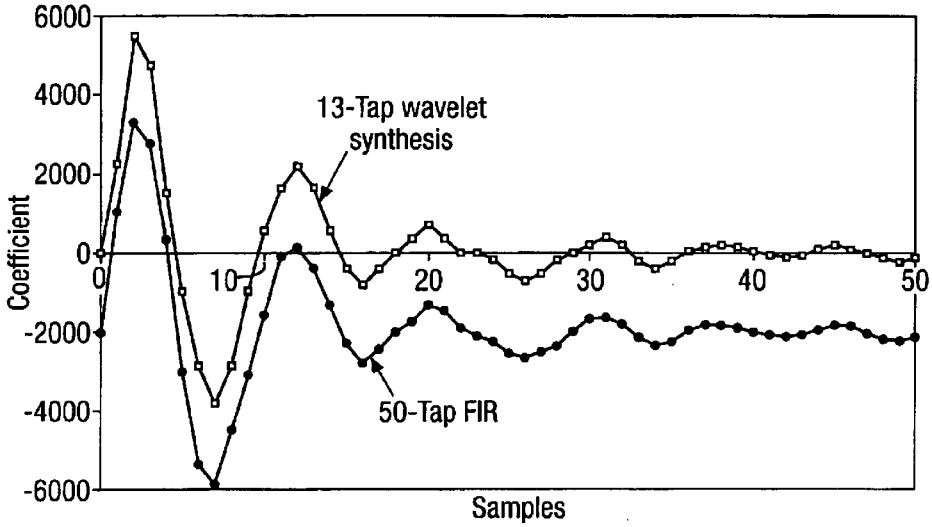
FIG. 19 shows the near ear part of an HRTF synthesised using the present invention.
Figure 20:
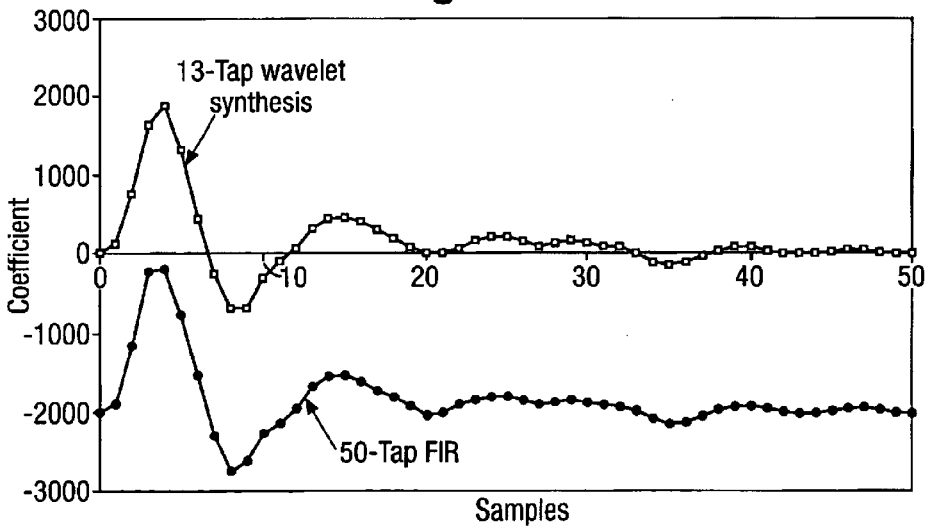
FIG. 20 shows the far ear part of an HRTF synthesised using the present invention.

For example, the 50-tap FIR impulse response of a typical HRTF filter (near-ear at 30 degrees azimuth) is shown in FIG. 19 (lower plot). The line has been offset by a factor of −2000 units in order to separate it from the adjacent plot and thus make visual comparison easier. By examination of its features, it would seem that it could be recreated using only three wavelet generators, namely 3, 4 and 5 tap types. Accordingly, the wavelet-generator coefficients for these types were calculated (shown below in Tables 8, 9, and 10), and the filter impulse characteristics were fitted using the method already described. The HRTF near-ear filter is shown in FIG. 19: the upper plot shows the impulse response of the wavelet-generator (only 13 taps are required plus 12 for the generators) and the lower plot shows the impulse response of a 50-tap FIR filter of the type which would be used conventionally. In all, then, the present approach requires only 50% of the processing power of the prior-art for this typical example. FIG. 20 shows the same plots for the far-ear filter, where only 14-taps (+12) are required. The filter coefficients used for FIGS. 19 and 20 are shown in Tables 11 and 12 respectively.

However, the real benefit accrues when a multiplicity of channels are required to be processed, because the wavelet generator elements can be shared by all the channels. One wavelet generator set would be required for the near-ear processing, and another for the far-ear processing. For example, considering, say, the HRTF filtering for the virtualisation of a "5.1 Surround" system, where it would be required to create five virtual sound sources. The prior-art processing load would be 5×50 taps (per side), i.e. 250 taps, whereas the present invention could achieve the same in (5×13)+12 taps=77 taps, thus requiring only 31% of the signal-processing ability.

TABLE 8

Wavelet generator coefficients for a 3-tap device

| Tap number | θ° (notional) equation (2) | F(θ°) equation (1) |
|---|---|---|
| 1 | 90 | 0.500 |
| 2 | 180 | 1.000 |
| 3 | 270 | 0.500 |

TABLE 9

Wavelet generator coefficients for a 4-tap device

| Tap number | θ° (notional) equation (2) | F(θ°) equation (1) |
|---|---|---|
| 1 | 72 | 0.345 |
| 2 | 144 | 0.905 |
| 3 | 216 | 0.905 |
| 4 | 288 | 0.345 |

TABLE 10

Wavelet generator coefficients for a 5-tap device

| Tap number | θ° (notional) equation (2) | F(θ°) equation (1) |
|---|---|---|
| 1 | 60 | 0.250 |
| 2 | 120 | 0.750 |
| 3 | 180 | 1.000 |
| 4 | 240 | 0.750 |
| 5 | 300 | 0.250 |

TABLE 11

Impulse-wavelet data for synthesis of the HRTF near-ear filter of FIG. 19

| wavelet number | wavelet-type (number of taps) | amplitude | trigger point (elapsed samples) |
|---|---|---|---|
| 1 | 3 | 1500 | 1 |
| 2 | 4 | 4400 | 1 |
| 3 | 5 | −3800 | 5 |
| 4 | 5 | 2200 | 10 |
| 5 | 3 | −800 | 15 |
| 6 | 3 | 700 | 19 |
| 7 | 5 | −700 | 24 |
| 8 | 3 | 400 | 30 |
| 9 | 3 | −400 | 33 |
| 10 | 5 | 200 | 36 |
| 11 | 3 | −100 | 41 |
| 12 | 3 | 200 | 44 |
| 13 | 3 | −200 | 48 |

TABLE 12

Impulse-wavelet data for synthesis of the HRTF far-ear filter of FIG. 20

| wavelet number | wavelet-type (number of taps) | amplitude | trigger point (elapsed samples) |
|---|---|---|---|
| 1 | 4 | 350 | 1 |
| 2 | 5 | 1750 | 2 |
| 3 | 4 | −760 | 7 |
| 4 | 3 | −100 | 10 |
| 5 | 3 | 200 | 12 |
| 6 | 5 | 450 | 13 |
| 7 | 4 | 200 | 16 |
| 8 | 5 | 200 | 22 |
| 9 | 3 | 90 | 25 |
| 10 | 5 | 160 | 27 |
| 11 | 3 | 80 | 31 |
| 12 | 5 | −150 | 33 |
| 13 | 4 | 90 | 38 |
| 14 | 4 | 60 | 45 |

Figure 21:
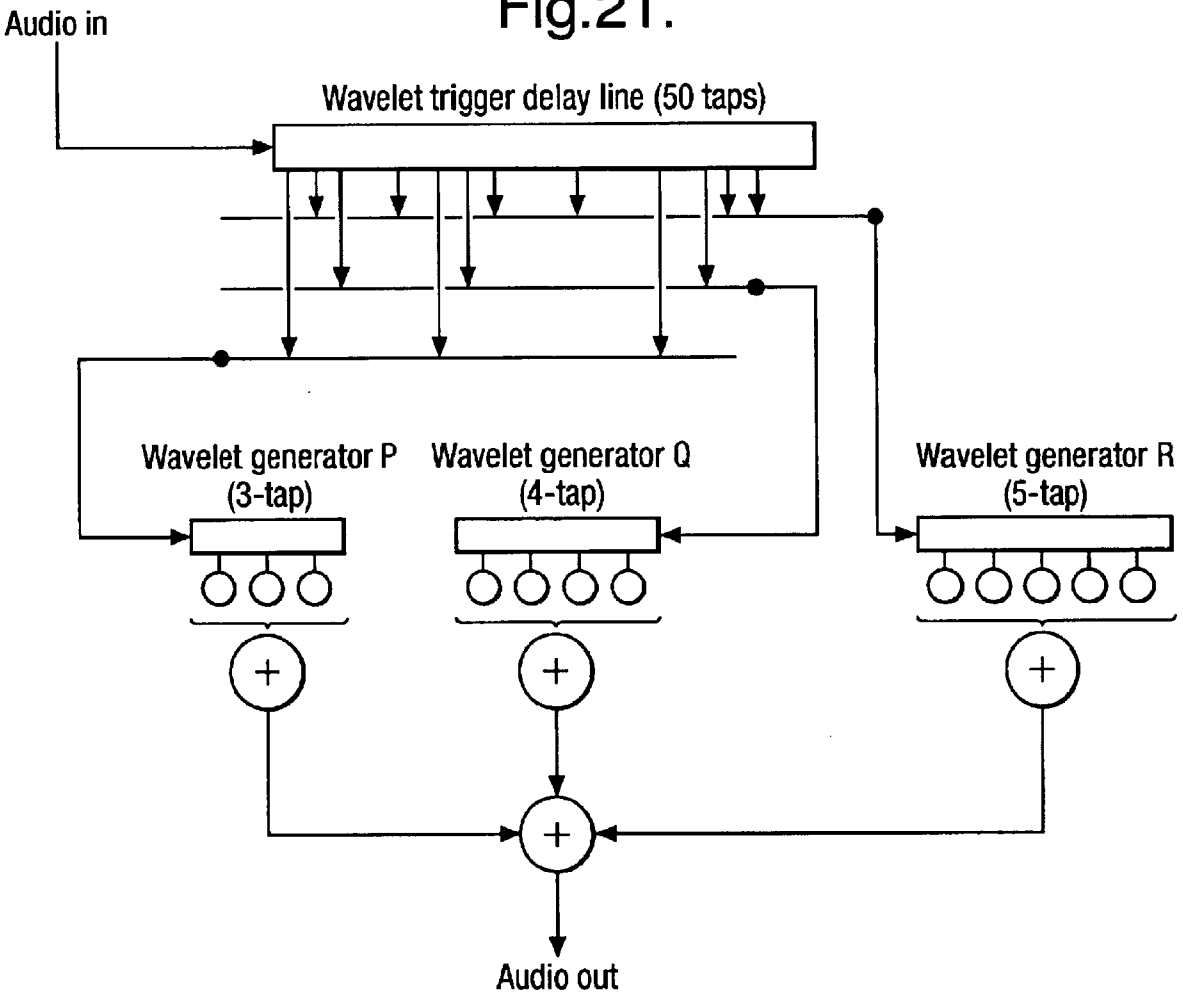
FIG. 21 shows the apparatus required to synthesise one half of an HRTF.

FIG. 21 shows the configuration required for one-half (e.g. near-ear) of such an HRTF processing arrangement, as will be appreciated according to the description already given. The incoming audio is passed along the 50-tap (in this case) delay line. It is tapped off at the indicated trigger points (Tables 11 and 12), and subjected to a gain adjustment according to the required amplitude (column 3), then it is summed to one of three common, shared buses, according to column 2. The buses each feed an associated wavelet generator (column 2), and the outputs of the three generators are all summed to form the final audio output.

It will be appreciated that in all the embodiments described thus far, the extended synthesised impulse response functions have been made up from identical part impulse response functions which have been gain adjusted and irregularly overlapped to avoid "flutter artefacts" commonly heard with repeated signals. The next embodiment describes a system in which such flutter artefacts are further mitigated.

This further embodiment will now be described with reference to FIGS. 22, 23 and 24), as follows. These three diagrams illustrate the development of the system from that which has already been described according to FIG. 16. The improvements relate to the sequencing and characteristics of the impulse-wavelets, which is depicted in its original form by FIG. 15.

The present invention is based on the synthesis of the impulse response of a block of scattering data, typically 8 ms in duration, and a particular, repetitive use of said block to achieve, in effect, the synthesis of a lengthier impulse response of scattering data. The period of 8 ms is a good compromise between providing an adequate natural signal with sufficient time-dependent variation, whilst minimising the signal-processing load required to implement it. It will be remembered that regular sequencing of an 8 ms block was audible as a "flutter" artefact, whereas irregular sequencing provided a much improved result. Nevertheless, the result is not entirely perfect, and critical listening tests using repeated 8 ms blocks of pink noise reveal a residual artefact.

In order to eliminate completely the artefact, it is necessary to eliminate the repetitive element completely, it seems, at least until the repetitive element is below audible limits by virtue of its frequency or relative amplitude or both of these. If it were possible, say, to extend the synthesised 8 ms block of scattered data to 32 ms, and then use this repetitively, then the frequency of repetition would be only 31 Hz, and the first repetition would occur via a feedback attenuator to reduce its amplitude to only 10% of its original amplitude (assuming a decay half-time of 10 ms). This would be most satisfactory, and would totally eliminate audible artefacts. However, this would require the extension of the wavelet trigger delay line from 8 ms to 32 ms, and the use of four times as many taps. For example, the 43 taps of Table 3, relating to the right-channel data of FIG. 4, would become 172 taps, and so the Wavelet Engine would impose a much greater signal-processing burden. In contrast, the original configuration of the irregularly repeated block implementation required only 79 taps (30 for all three wavelet generators, plus 43 for the initiation points, 5 for the irregular sequencing and 1 for the feedback). As stated earlier, the goal, bearing in mind present-day signal processing capabilities, is a wave-scattering synthesiser which uses less than 100 taps.

The goal of providing lengthy, non-repetitive wave-scattering data blocks without significantly increasing the signal processing requirements is achieved by employing a pair of wavelet-trigger delay lines, used alternately, and dynamically changing the tapping points and coefficients relating to the scattering data in the "out-of-use" line during its redundant part of the cycle. This leads to further economies, as will be shown.

Figure 22:
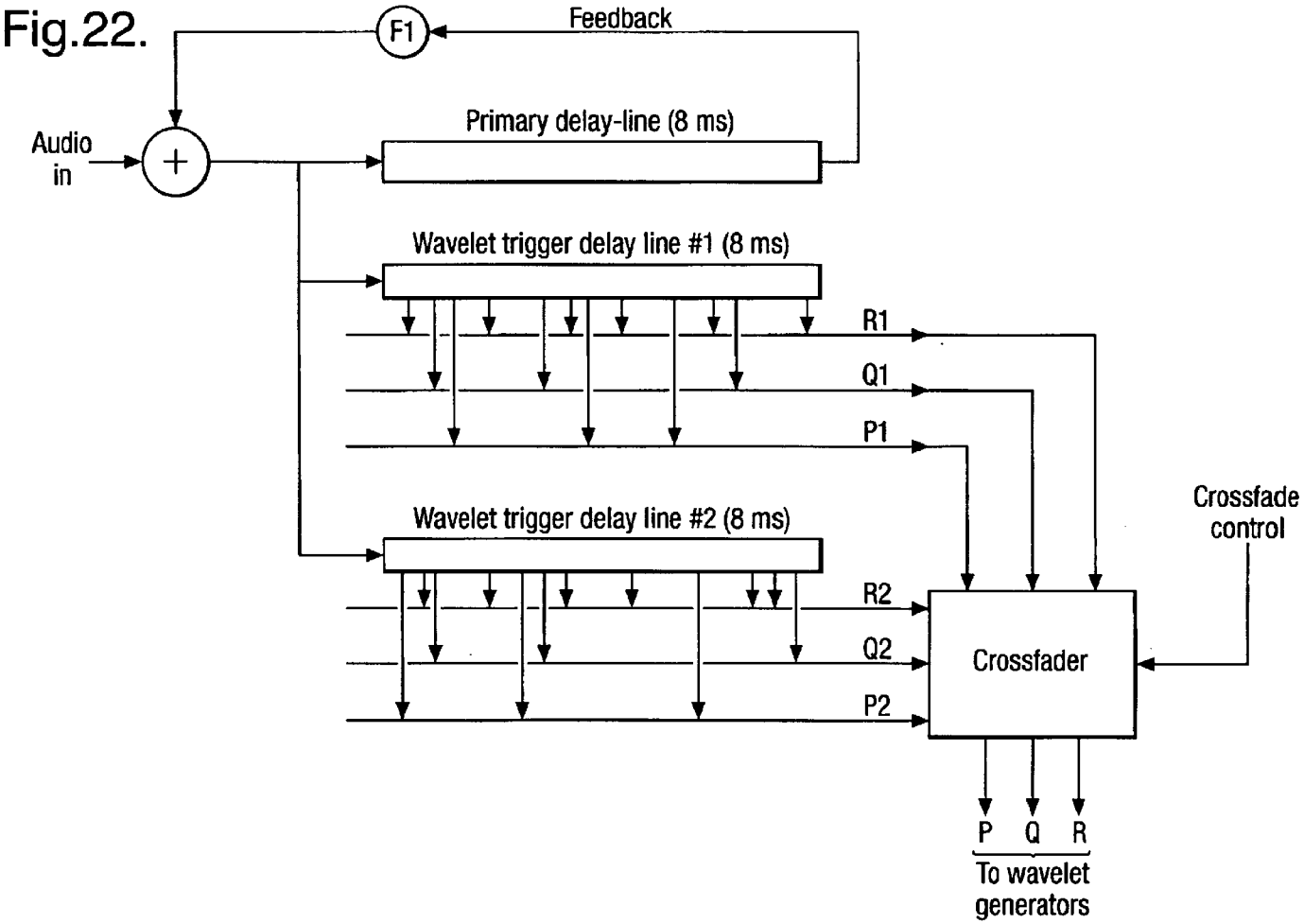
FIG. 22 shows a further embodiment of the present invention used when adjacent synthesised part impulse responses are different.

First, FIG. 22 shows a practical embodiment of the invention. Consider an incoming impulse, which feeds into a first summing node, and thence both into a primary delay-line (say, for example, 8 ms in length), and also into two wavelet trigger delay-lines (also 8 ms in length). As already described, each wavelet trigger delay-line possesses a number of different taps according to a different predetermined wave-scattering impulse characteristic (e.g. Table 3), each tap having an associated gain/attenuation factor, and feeding one of several (three in this instance) wavelet generator input buses, labelled P, Q and R. Here, for example, in FIG. 22, the wave-scattering data in wavelet-trigger delay line #1 relates to a first 8 ms period of a 32 ms period of recorded or synthesised wave-scattering data, and the wave-scattering data in wavelet-trigger delay line #2 relates to the second, subsequent 8 ms period of a 32 ms period of recorded or synthesised wave-scattering data. The wavelet-generator input buses from wavelet-trigger delay-line #1 are labelled P1, Q1 and R1, and the wavelet-generator input buses from wavelet-trigger delay-line #2 are labelled P2, Q2 and R2. Both pairs of buses feed into a cross-fading device, controlled as part of the Wavelet Engine. The cross-fading device possesses a single set of output buses which feed into the wavelet-generators (FIG. 14) exactly as before. The cross-fading device adds together the respective input bus data on a proportional basis, and feeds the result to the respective output buses. The purpose of the device is to fade the wavelet generator inputs progressively from either one of the two wavelet-trigger delay-line bus sets to the other without introducing any audible artefacts. In practise, it has been found that linear cross-fading over a period somewhere in the range 50 to 100 samples, at a sampling frequency of 44.1 kHz, is sufficiently long to avoid artefacts. The present invention, dealing with secondary signals, rather than primary, direct sounds, is less demanding, and so a minimal cross-fade period of 50 samples is adequate. Hence, during a 50-sample cross-fade period from, say, delay-line #1 to delay-line #2, each of the output buses would carry a proportional additive mix of the two respective input buses, such that the proportion value would increase (from delay-line #2) or decrease (from delay-line #1) methodically in 2% increments (or decrements), as shown in Table 13, below.

TABLE 13

Proportional cross-fading between the two wavelet generator buses

| cross-fade cycle point (samples) | P bus output | Q bus output | R bus output |
|---|---|---|---|
| 0 | 100% P1 | 100% Q1 | 100% R1 |
| 1 | 98% P1 + 2% P2 | 98% Q1 + 2% Q2 | 98% R1 + 2% R2 |
| 2 | 96% P1 + 4% P2 | 96% Q1 + 4% Q2 | 96% R1 + 4% R2 |
| 3 | 94% P1 + 6% P2 | 94% Q1 + 6% Q2 | 94% R1 + 6% R2 |
| . | . | . | . |
| . | . | . | . |
| . | . | . | . |
| 48 | 4% P1 + 96% P2 | 4% Q1 + 96% Q2 | 4% R1 + 96% R2 |
| 49 | 2% P1 + 98% P2 | 2% Q1 + 98% Q2 | 2% R1 + 98% R2 |
| 50 | 100% P2 | 100% Q2 | 100% R2 |

Instead of requiring a single set of scattering data values linking the wavelet trigger delay line to its respective buses, it is now required that, say, four differing data sets are required, each of the format of Table 3. These are obtained either by measurement or synthesis, for example, of a 32 ms scattering period, such that the data sets correspond to the periods 0–8 ms; 8–16 ms; 16–24 ms and 24–32 ms.

Hence, at the outset, with the first (0–8 ms) data set loaded into delay-line #1, and the second (8–16 ms) loaded into delay-line #2, the cross-fader is set to pass all of the #1 bus data to its output, and none of the #2 bus data. Over the course of the next 306 sample periods, the impulse travels in parallel along both the #1 and #2 delay lines, but generating wavelets only from the #1 bus (because the cross-fader has selected it). On the $307^{th}$ sample, the cross-fade cycle is initiated, and takes place over the course of the next 50 samples, after which delay-line #2 is now solely feeding the wavelet generators. At this point, the initial impulse is fed back regeneratively from the primary delay-line output to its input via the first summing node, and also to both wavelet trigger delay lines again. This continues the process, as before, but with line #2 the "active" one, and #1 the "inactive" one, because of the cross-fade selection, thus creating the characteristics of the second scattering block (8–16 ms). At this stage, the third (16–24 ms) data set is loaded into delay-line #1, in readiness for the subsequent cycle. Again, after sample 307 of the second cycle, the cross-fade is initiated, this time from line #2 back to line #1, such that in the third cycle, the characteristics of the third scattering block (16–24 ms) are generated. During this (third) cycle, the last of the four data sets is loaded into delay-line #2, and the process continues such that at the end of the four, 8 ms cycles, a full 32 ms scattering episode has been synthesised without any repetition. By virtue of the feedback element in the primary delay line, however, the process continues ad infinitum in a natural and diminishing manner, thus creating a realistic decay profile for the wave-scattering synthesis. (The above description has been simplified for clarity, the precise alignment of the scattering data during the cross-fade has been ignored at this stage.)

Figure 23:
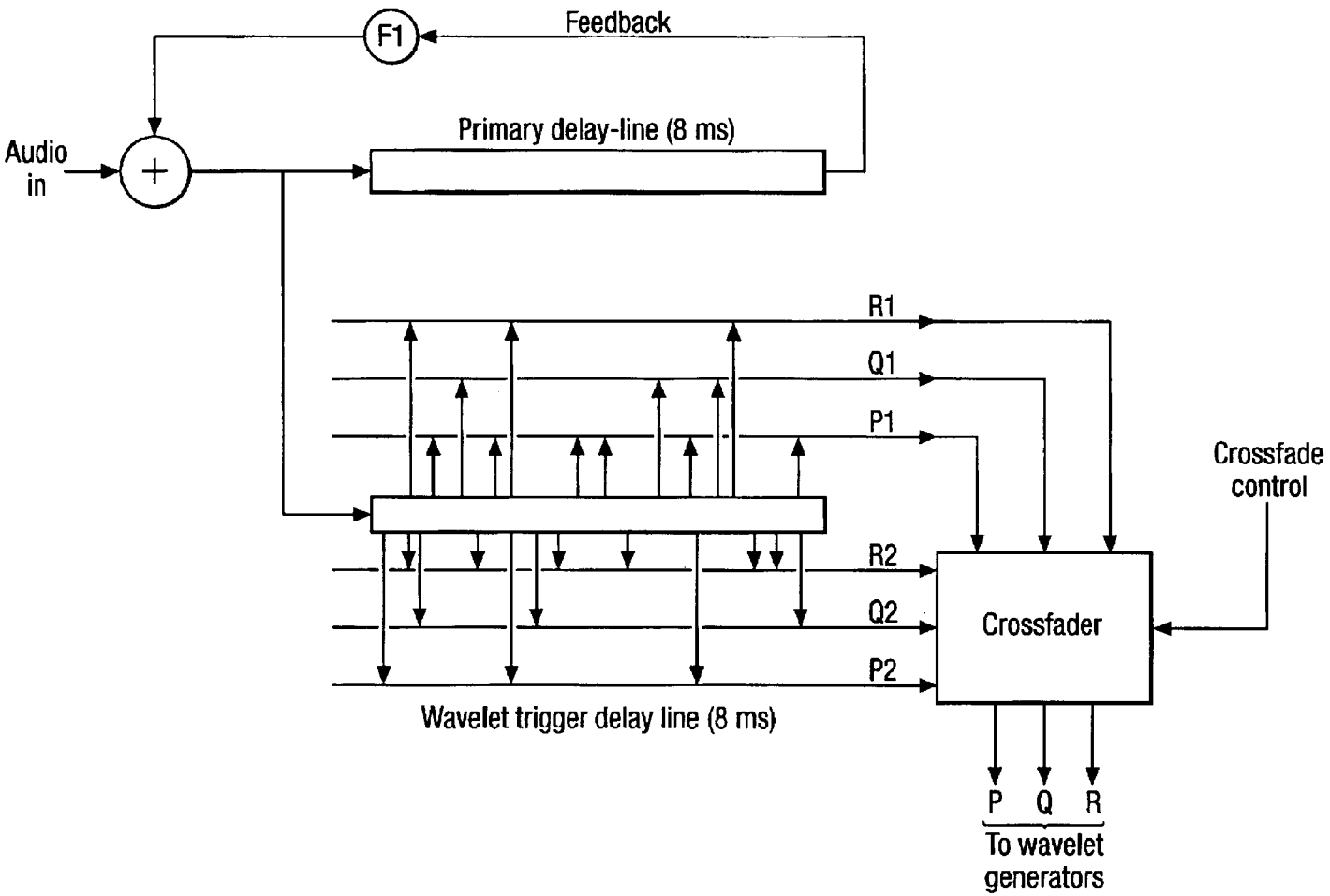
FIG. 23 shows how the arrangement of FIG. 22 can be simplified.
Figure 24:
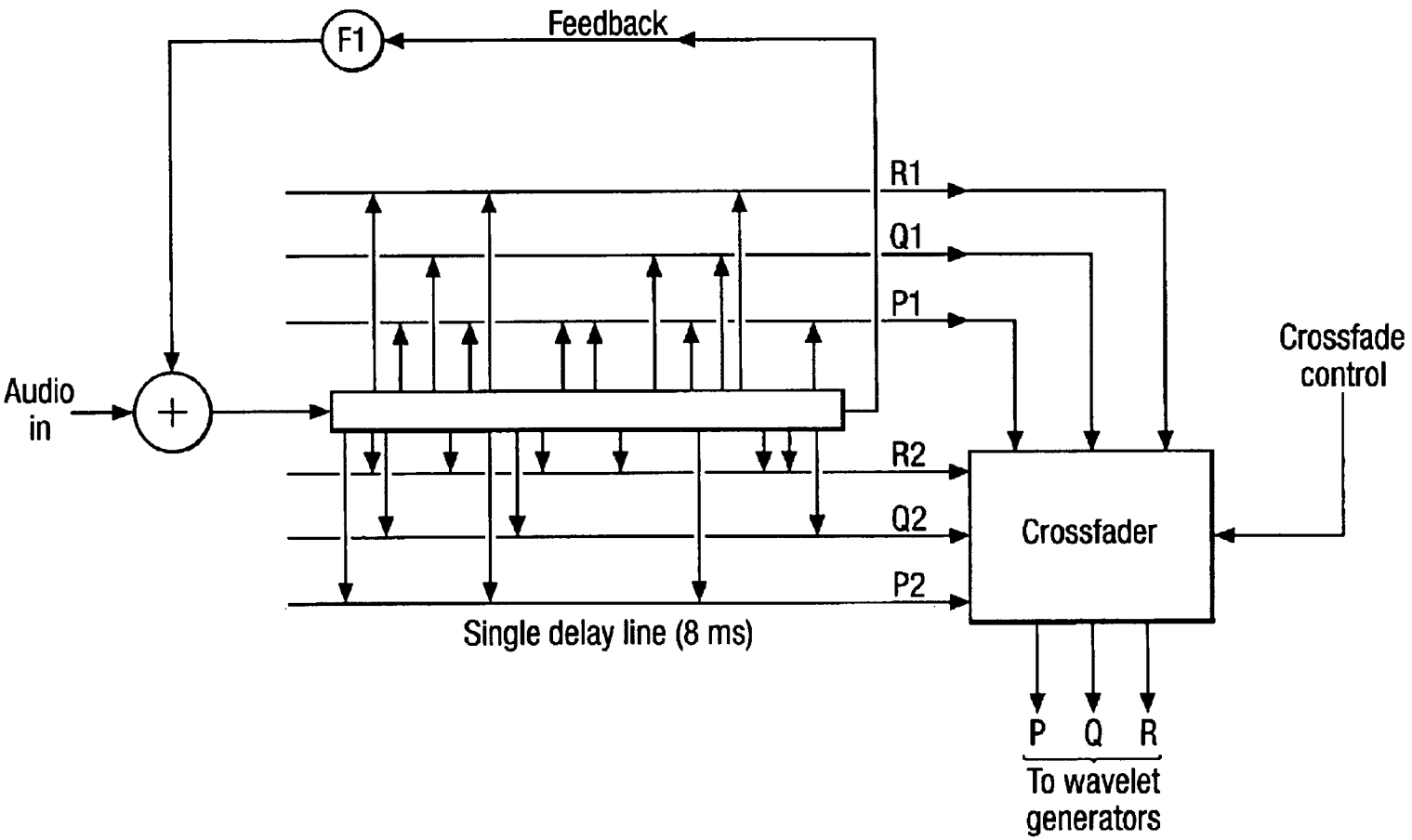
FIG. 24 shows how the arrangement of FIG. 23 can be further simplified.

The invention can be simplified further, as indicated in FIG. 23. As both wavelet trigger delay-lines #1 and #2 carry the same audio data, one of them is redundant. The taps can be derived from a single delay line, and they can be implemented as and when required. Conventionally, the audio data exists in a circular read-write buffer, and the taps merely represent address locations within the buffer. Consequently, FIG. 23 shows a simplified embodiment of the invention which is equally effective as that of FIG. 22.

It should be noted that because the primary delay line was intended originally to create irregular impulses during a 33 ms period, it could not be shortened. However, we are now dealing with the regular repetition of non-repetitive data blocks, and the regular repetition is created by the primary, 8 ms delay-line (FIGS. 22 & 23). This has removed the need for a lengthy (33 ms) delay-line, which requires considerable data memory. There is, however, a further economy which can be made. The architecture can be further simplified, as shown in FIG. 24. By using a feedback signal from the wavelet trigger delay-line, the primary delay-line becomes redundant, and so the system is much simplified.

The signal-processing load has now been increased a little during the cross-fade cycle, which occurs for 50 samples per 356, representing approximately a 14% increase in respect of the initiation-point taps. The load is now: 30 taps for all three wavelet generators; 43×1.14 for the initiation points, none for the irregular sequencing and 1 for the feedback, i.e. 80 taps in all (compared to 79 taps previously).

This improved configuration requires a slightly different approach in terms of the formatting of the wave-scattering data, as follows. In the first embodiment of the invention, where an 8 ms block of wave-scattering data was repeated irregularly, it was required that the envelope of the scattering possessed a time-dependent exponential decay characteristic. This is an intrinsic characteristic of both real, recorded signals, and synthesised signals from a finite-element model, provided that the data is not acquired during the very first few milliseconds following the direct sound arrival, as has already been described. In operation, the re-iterative feedback via attenuator F1 ensures that each repeated block is subjected to a proportional gain reduction, and this becomes compounded to create an exponential envelope. It is desirable, of course, that the time-constant of the source data and the time-constant of the feedback system are consistent. Ideally, they should be identical. If it is required that the decay characteristics of the synthesised scattering differ from that intrinsic to the source data, then there would be a small inconsistency.

In practise, the intrinsic exponential decay exhibited in the 8 ms data blocks is somewhat small, and it is visually masked by the irregularities in the wave-data itself, as can be seen in the Figures herein. However, the improved configuration of the invention requires the characterisation of a longer data-block, say, 32 ms in duration, and the exponential decay exhibited over such a relatively long period is significantly larger. Furthermore, it is required that this data be sectioned into smaller blocks (e.g. four blocks of 8 ms duration each), such that each block possesses the same envelope characteristics in terms of initial amplitude and decay time constant, and so the re-iterative feedback attenuation factor is responsible for the successive reduction in gain of the synthesised data on a block-by-block basis.

In order to format the scattering data appropriately, the following method is used.

Figure 25:
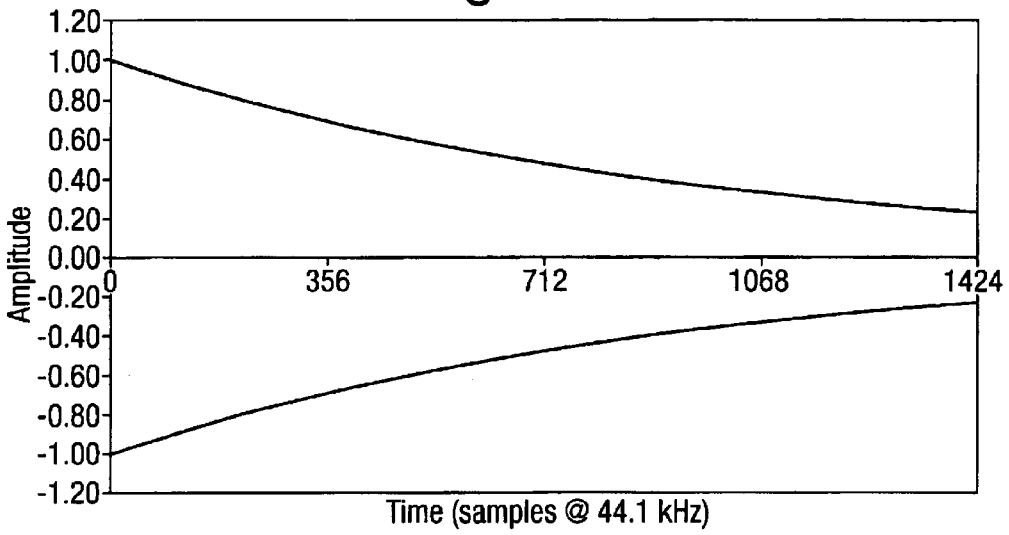
FIG. 25 shows a 32 ms impulse response amplitude envelope with exponential decay.
Figure 26:
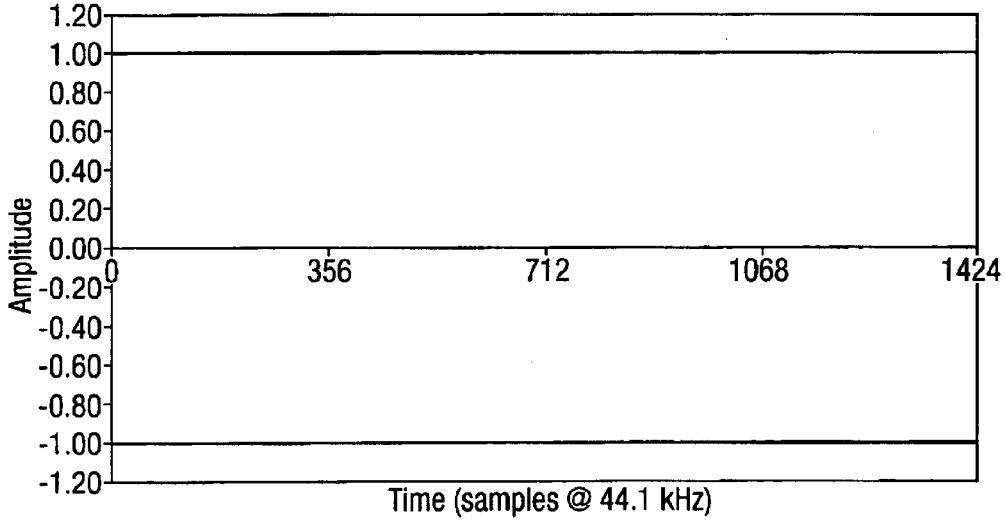
FIG. 26 shows the envelope of FIG. 25 normalised to compensate for the decay.
Figure 27:
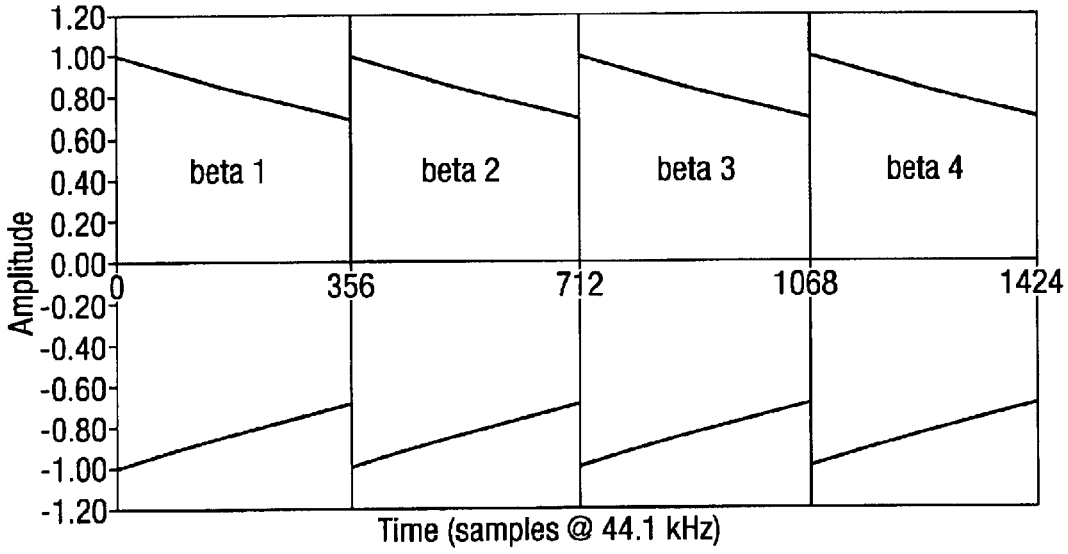
FIG. 27 shows the impulse response amplitudes required to synthesise a response as in FIG. 25 if 8 ms blocks are employed with iterative feedback using a gain/attenuation factor of less than 1.

1. A suitable 32 ms section of a wave-scattering impulse response is recorded or synthesised, and used as the source signal. This would typically have an amplitude envelope as shown schematically in FIG. 25.
2. The source signal is subjected to a time-dependent logarithmic gain increase ("fade-in"), such that the signal envelope becomes flat. That is, the envelope amplitude is constant throughout the 32 ms period, and so the average amplitude of the signal is just as large at the end of the period as it was at the beginning. This becomes the "flat-envelope source" signal, shown in FIG. 26.
3. By curve fitting, as already described, the flat-envelope source signal is used to generate the tap data (tap timing positions and gain coefficients) for the Wavelet Engine. This is the flat-envelope tap data.
4. The flat-envelope tap data, which extends over the 32 ms period, is partitioned into several successive sections. For example, let us say there are four, 8 ms sections, call them "β1", "β2", "β3" and "β4" respectively.
5. The tap amplitude data in each of the sections "β1", "β2", "β3" and "β4" are subjected to a time-dependent exponential attenuation factor according to the required decay time-constant. This is carried out individually, on a block-by-block basis, using equation 2, and defining the first sample in each block to be t=0, such that the signal envelopes corresponding to the four data blocks are identical, as shown in FIG. 27.

For example, if it were required that a 15 ms half-life were required for the scattering data, and four, 8 ms blocks were in use according to the embodiment of FIG. 23, then the following calculations would be used. From equation (2), the exponential time-constant associated with a half-life of 15 ms is approximately 46.2 $s^{-1}$, such that equation (2) becomes:

$$A_t = A_0 e^{-46(t)} \tag{3}$$

Referring to the data of Table 3 as an example, each tap data set comprises a wavelet-type, an amplitude and a trigger point (call it TP) expressed in terms of number of samples elapsed since the beginning of the data block. For a sampling rate of 44.1 kHz, then, equation (3) becomes:

$$A_t = A_0 e^{-46\left(\frac{TP}{44,100}\right)} \tag{4}$$

This expresses the attenuation factor, $A_t$, to be applied to the amplitude coefficient of every tap as a function of its trigger point, TP. For example, using the 15 ms half-life example (and assuming $A_0$, is unity), then when TP=0, $A_t$ is equal to 1.00, and when TP=100, then $A_t$ is equal to 0.90. When TP=356 (i.e. the last sample in the block), then $A_t$ is equal to 0.69, and this, of course, also corresponds to the value of the feedback factor, F1. Then attenuation factor F1 (equal to 0.69 in the present case) is used to multiply the amplitude for the second block, which will thus start at 0.69 and decrease to $(0.69)^2$. The attenuation factor F1 is used to multiply the amplitude again for the third block, which will thus start at $(0.69)^2$ and reduce to $(0.69)^3$, and so on to give an exponential decay of amplitude over the 4 blocks.

In summary, this further embodiment provides truly non-repetitive wave-scattering engine with virtually no additional processing burden and with the saving of a 33 ms delay line.

Signal processing apparatus for putting the present invention into effect can be incorporated into portable audio systems such as MP3 players or CD or mini disc systems, into musical instruments such as electronic keyboards/synthesisers, mobile or cellular telephones, or into any apparatus using headphones.

There are other fields in which the synthesis of turbulent wave data would be advantageous, and the present invention will have application there also. For example, the synthesis of scattered waves for sonar or radar applications. Clearly for electromagnetic field scattering other functions than that of the raised sine (for example the gaussian function) could be used, as the presence of audible clicks and pops will not be a problem.

It should be noted that various component elements of the invention can be configured in many different ways, with longer or shorter time-delays, greater or smaller numbers of impulse-wavelet (basis function) generators and so on. The example depicted herein was chosen as an illustrative example, to demonstrate a typical configuration based on real, recorded data, and with its operation confirmed by synthesis and critical audition using headphones. In particular, the choice of part impulse response functions having a duration of 8 or 32 ms was purely for illustrative purposes.

Finally, the accompanying abstract is incorporated herein by reference.

What is claimed is:

1. A method of synthesizing an approximate impulse response function from a measured first impulse response function in a given sound-field, the method comprising:

sampling an early part of the first impulse response function for the given sound-field, synthesizing a first approximate partial impulse response, by curve fitting using a plurality of basis functions provided by respective multi-tap FIR filters having different numbers of taps, which approximates to a sample, synthesizing a second approximate partial impulse responses using the respective multi-tap FIR filters, applying an envelope function which decreases an amplitude of said second partial impulse responses with increasing elapsed time, and combining the synthesised first approximate partial impulse responses with the synthesised second approximate partial impulse response to provide the synthesised approximate impulse response function.

2. A method as claimed in claim 1, wherein:

the synthesised first approximate partial impulse response and the synthesised second approximate partial impulse responses are identical, and are combined with irregular overlap.

3. A method as claimed in claim 1, wherein:

the synthesised first approximate partial impulse response and the synthesised second approximate partial impulse responses are different.

4. A method as claimed in claim 3, wherein:

the first approximate partial impulse response is synthesised using a pair of groups of taps having different tap positions and/or coefficients, and means for cross-fading successively from one group to another.

5. A method as claimed in claim 4, wherein:

coefficients and/or tap positions of one group of taps are changed whilst the other group is being used, such that each time a group of taps is used they have a different set of coefficients and/or tap positions.

6. A method as claimed in claim 1, wherein:

successive synthesised approximate partial impulse responses are modified in real time to provide an interactive system.

7. A method as claimed in claim 1, wherein:

the plurality of basis functions are "raised sine" functions having respective different periods.

8. A method as claimed in claim 1, wherein:

a group of irregularly overlapped synthesised partial impulse responses is repeated to provide an extended approximate impulse response.

9. A method as claimed in claim 1, wherein:

a group of regularly overlapped synthesised partial impulse responses is repeated to provide an extended approximate impulse response.

10. A method as claimed in claim 8, wherein:

the group is repeated periodically to provide an extended approximate impulse response.

11. A method as claimed in claim 1, wherein:

the first impulse response function is low-pass filtered before curve fitting, such that frequencies above 10 kHz are removed.

12. A method as claimed in claim 1, wherein:

the first impulse response function is low-pass filtered before curve fitting, such that frequencies above 7 kHz are removed.

13. A method as claimed in claim 1, wherein:

the first impulse response function is low-pass filtered before curve fitting, such that frequencies above 5 kHz are removed.

14. A method as claimed in claim 1, wherein:

the synthesised approximate impulse response function is an ear response transfer function.

* * * * *